US008679723B2

(12) United States Patent
Masuda et al.

(10) Patent No.: US 8,679,723 B2
(45) Date of Patent: Mar. 25, 2014

(54) METHOD OF MANUFACTURING TONER

(75) Inventors: Minoru Masuda, Shizuoka (JP); Yasutada Shitara, Shizuoka (JP); Yoshihiro Norikane, Kanagawa (JP); Kiyotada Katoh, Shizuoka (JP); Satoshi Takahashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/433,981

(22) Filed: Mar. 29, 2012

(65) Prior Publication Data

US 2012/0264049 A1 Oct. 18, 2012

(30) Foreign Application Priority Data

Apr. 12, 2011 (JP) ..... 2011-087965

(51) Int. Cl.
*G03G 5/00* (2006.01)

(52) U.S. Cl.
USPC ..... 430/137.1

(58) Field of Classification Search
USPC ..... 430/137.1
See application file for complete search history.

(56) References Cited

U.S. PATENT DOCUMENTS

| | | | |
|---|---|---|---|
| 5,721,083 | A | 2/1998 | Masuda et al. |
| 6,406,826 | B1 | 6/2002 | Suzuki et al. |
| 6,818,369 | B2 | 11/2004 | Sugiura et al. |
| 6,828,075 | B2 | 12/2004 | Suzuki et al. |
| 6,861,191 | B2 | 3/2005 | Mochizuki et al. |
| 7,169,522 | B2 | 1/2007 | Sugiura et al. |
| 7,183,029 | B2 | 2/2007 | Masuda et al. |
| 7,522,857 | B2 | 4/2009 | Hasegawa et al. |
| 7,713,672 | B2 | 5/2010 | Watanabe et al. |
| 7,718,340 | B2 | 5/2010 | Iwamoto et al. |
| 7,759,036 | B2 | 7/2010 | Utsumi et al. |
| 7,862,973 | B2 | 1/2011 | Nakayama et al. |
| 7,985,518 | B2 | 7/2011 | Shu et al. |
| 8,007,974 | B2 | 8/2011 | Nakayama et al. |
| 8,029,961 | B2 | 10/2011 | Kuramoto et al. |
| 8,034,523 | B2 | 10/2011 | Hasegawa et al. |

(Continued)

FOREIGN PATENT DOCUMENTS

| | | |
|---|---|---|
| JP | 57-201248 | 12/1982 |
| JP | 2003-262976 | 9/2003 |

(Continued)

OTHER PUBLICATIONS

U.S. Appl. No. 13/251,606, filed Oct. 3, 2011, Yoshihiro Norikane, et al.

*Primary Examiner* — Thorl Chea
(74) *Attorney, Agent, or Firm* — Oblon, Spivak, McClelland, Maier & Neustadt, L.L.P.

(57) ABSTRACT

A method of manufacturing toner is provided. The method includes preparing a toner constituents liquid by dissolving or dispersing toner constituents in an organic solvent. The toner constituents includes a binder resin and a charge controlling agent. The charge controlling agent includes a polycondensation product of a phenol with an aldehyde. The method further includes forming a liquid column resonance standing wave in the toner constituents liquid in a chamber having at least one nozzle by vibrating the toner constituents liquid. The method further includes forming the toner constituents liquid into liquid droplets by discharging the toner constituents liquid from the nozzle. The nozzle is disposed within an area including antinodes of the liquid column resonance standing wave. The method further includes removing the organic solvent from the liquid droplets to solidify the liquid droplets.

7 Claims, 15 Drawing Sheets

(56) References Cited

U.S. PATENT DOCUMENTS

| | | | | |
|---|---|---|---|---|
| 8,034,526 | B2 | 10/2011 | Watanabe et al. | |
| 8,084,176 | B2 | 12/2011 | Iwamoto et al. | |
| 8,105,742 | B2 | 1/2012 | Norikane et al. | |
| 2003/0152857 | A1 | 8/2003 | Sugiura et al. | |
| 2006/0068306 | A1 | 3/2006 | Shu et al. | |
| 2006/0083999 | A1* | 4/2006 | Ishimoto et al. | 430/108.1 |
| 2006/0093943 | A1 | 5/2006 | Shu et al. | |
| 2007/0275315 | A1 | 11/2007 | Nagatomo et al. | |
| 2009/0117486 | A1 | 5/2009 | Watanabe et al. | |
| 2009/0239170 | A1 | 9/2009 | Honda et al. | |
| 2009/0325100 | A1 | 12/2009 | Watanabe et al. | |
| 2010/0003613 | A1 | 1/2010 | Honda et al. | |
| 2010/0021209 | A1* | 1/2010 | Watanabe et al. | 399/252 |
| 2010/0227267 | A1 | 9/2010 | Shitara et al. | |
| 2011/0014565 | A1 | 1/2011 | Norikane et al. | |
| 2011/0305987 | A1 | 12/2011 | Yohichiroh et al. | |
| 2012/0070777 | A1* | 3/2012 | Makabe et al. | 430/137.14 |
| 2012/0094231 | A1* | 4/2012 | Norikane et al. | 430/137.1 |

FOREIGN PATENT DOCUMENTS

| | | |
|---|---|---|
| JP | 2003-262977 | 9/2003 |
| JP | 2005-258102 | 9/2005 |
| JP | 2010-49228 | 3/2010 |
| JP | 2010-117383 | 5/2010 |
| JP | 2011-22181 | 2/2011 |

* cited by examiner

FUNDAMENTAL PARTICLE (4.2 μm)

2 PARTICLES COALESCED (5.3 μm)

3 PARTICLES COALESCED (6.1 μm)

4 PARTICLES COALESCED (6.7 μm)

FUNDAMENTAL PARTICLE

2 PARTICLES COMBINED

3 PARTICLES COMBINED

METHOD OF MANUFACTURING TONER

CROSS-REFERENCE TO RELATED APPLICATIONS

This patent application is based on and claims priority pursuant to 35 U.S.C. §119 to Japanese Patent Application No. 2011-087965, filed on Apr. 12, 2011, in the Japanese Patent Office, the entire disclosure of which is hereby incorporated herein by reference.

BACKGROUND

1. Technical Field

The present disclosure relates to a method of manufacturing toner.

2. Description of Related Art

In an electrophotographic or electrostatic image forming apparatus, an electrostatic latent image is formed on a photoreceptor and the electrostatic latent image is developed into a toner image. The toner image is transferred onto a recording medium such as paper and fixed thereon by application of heat and pressure.

To meet recent demand for high-quality image, toner has been developed to have a smaller particle size so that latent images can be more precisely reproduced. Toner has been also developed to have environmentally-resistant chargeability so that latent images can be reliably developed into toner images regardless of temperature and humidity conditions.

Polymerization methods producing toner in aqueous media have been proposed. Polymerization methods generally produce a toner having a small size, a narrow size distribution, and substantially spherical shape, while consuming large amounts of time, water, and energy. For example, a polymerization method requires a long time period for completing the polymerization and another time period for separating the resultant toner particles from solvent. The toner particles are repeatedly subjected to washing and drying while consuming water and energy.

Japanese Patent Nos. 3786034 and 3786035 and Japanese Patent Application Publication No. 57-201248 each propose a method called injection granulation method for manufacturing toner. In injection granulation methods, raw materials of toner are dissolved or dispersed in an organic solvent and the resulting liquid is atomized. The atomized particles are dried into toner particles. Because water is not used, injection granulation methods do not need washing and drying processes, which results in drastic reduction of consumed amounts of time and energy.

In injection granulation methods, some atomized particles may coalesce before the organic solvent is removed therefrom and the coalesced particle is dried into toner particle. As a result, the resulting toner particles have a wide size distribution. Because the atomized particles are spherical due to surface tension, the resulting toner particles are also spherical. Spherical toner particles are difficult to remove when remaining on a photoreceptor.

SUMMARY

In accordance with some embodiments, a method of manufacturing toner is provided. The method includes preparing a toner constituents liquid by dissolving or dispersing toner constituents in an organic solvent. The toner constituents includes a binder resin and a charge controlling agent. The charge controlling agent includes a polycondensation product of a phenol with an aldehyde. The method further includes forming a liquid column resonance standing wave in the toner constituents liquid in a chamber having at least one nozzle by vibrating the toner constituents liquid. The method further includes forming the toner constituents liquid into liquid droplets by discharging the toner constituents liquid from the nozzle. The nozzle is disposed within an area including antinodes of the liquid column resonance standing wave. The method further includes removing the organic solvent from the liquid droplets to solidify the liquid droplets.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
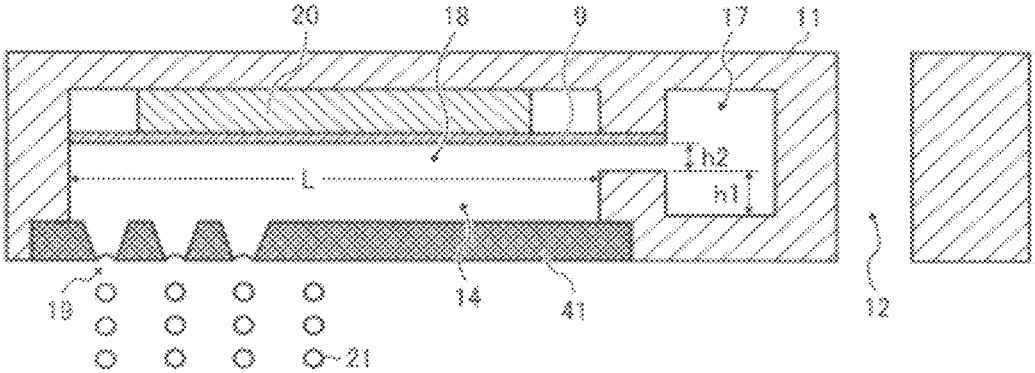
FIG. 1 is a cross-sectional view of a liquid droplet discharge head according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

A method of manufacturing toner according to an embodiment includes preparing a toner constituents liquid by dissolving or dispersing toner constituents in an organic solvent. The toner constituents includes a binder resin and a charge controlling agent. The charge controlling agent includes a polycondensation product of a phenol with an aldehyde. The method further includes forming a liquid column resonance standing wave in the toner constituents liquid in a chamber having at least one nozzle by vibrating the toner constituents liquid. The method further includes forming the toner constituents liquid into liquid droplets by discharging the toner constituents liquid from the nozzle. The nozzle is disposed within an area including antinodes of the liquid column resonance standing wave. The method further includes removing the organic solvent from the liquid droplets to solidify the liquid droplets.

Figure 2:
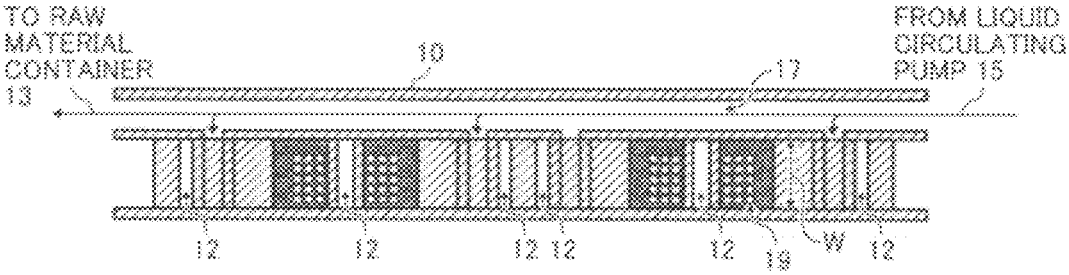
FIG. 2 is a cross-sectional view of a liquid droplet forming unit according to an embodiment.

FIG. 1 is a cross-sectional view of a liquid droplet discharge head according to an embodiment. FIG. 2 is a cross-sectional view of a liquid droplet forming unit according to an embodiment. A liquid droplet discharge head 11 has a liquid common supply path 17 and a liquid column resonance liquid chamber 18. The liquid column resonance liquid chamber 18 is communicated with the liquid common supply path 17 disposed on its one end wall surface in a longer direction. The liquid common supply path 18 has nozzles 19 on one end wall surface in a shorter direction. The nozzles 19 are adapted to discharge toner liquid droplets 21.

The liquid column resonance liquid chamber 18 also has a vibration generator 20 on the wall surface facing the nozzles 19. The vibration generator 20 is adapted to generate high-frequency vibration for generating a standing wave in liquid column resonance. The vibration generator 20 is connected to a high-frequency power source.

The liquid common supply path 17 is communicated with a plurality of liquid column resonance liquid chambers 18. Each of the liquid column resonance liquid chambers 18 is communicated with the liquid common supply path 17 through each liquid supply path.

A toner constituents liquid 14 is flowed into the liquid common supply path 17 disposed in a liquid droplet forming unit 10 by a liquid circulating pump and is supplied to each liquid column resonance liquid chamber 18. Within the liquid column resonance liquid chamber 18, the vibration generator 20 causes liquid column resonance and generates a pressure standing wave. Thus, a pressure distribution is formed therein. The toner liquid droplets 21 are discharged from the nozzles 19.

The nozzles 19 are disposed within an area including antinodes of the pressure standing wave generated in liquid column resonance. Within the area including antinodes of the pressure standing wave, the amplitude of pressure variation is large enough to discharge the toner liquid droplets 21. The area including antinodes is defined as an area including no nodes of the pressure standing wave. Within the area including antinodes of the pressure standing wave, each of the multiple nozzles 19 discharges uniform liquid droplets at a high efficiency without causing nozzle clogging. In some embodiments, the nozzles 19 are disposed within an area extending from a position at a local maximum amplitude toward a position at a local minimum amplitude for a distance ±⅛ of the wavelength of the pressure standing wave.

After passing the liquid common supply path 17, the toner constituents liquid 14 flows into a liquid return pipe and returns to a raw material container. As the toner liquid droplets 21 are discharged, the amount of the toner constituents liquid 14 in the liquid column resonance liquid chamber 18 is reduced and suction force generated by the action of the standing waves occurred in liquid column resonance is also reduced within the liquid column resonance liquid chamber 18. Thus, the liquid common supply path 17 temporarily increases the flow rate of the toner constituents liquid 14 to fill the liquid column resonance liquid chamber 18 with the toner constituents liquid 14. After the liquid column resonance liquid chamber 18 is refilled with the toner constituents liquid 14, the flow rate of the toner constituents liquid 14 in the liquid common supply path 17 is returned. The toner constituents liquid 14 then starts circulating through a liquid supply pipe and the liquid return pipe again.

In some embodiments, the liquid column resonance liquid chamber 18 is formed of joined frames formed of a material having a high stiffness which does not adversely affect liquid resonant frequency of the toner constituent liquid 14 at drive frequency. Such materials include metals, ceramics, and silicon.

Referring to FIG. 1, a length L between both longitudinal ends of the liquid column resonance liquid chamber 18 may be determined based on a liquid column resonance principle to be described in detail later. Referring to FIG. 2, a width W of the liquid column resonance liquid chamber 18 may be smaller than half of the length L so as not to give excessive frequency to the liquid column resonance.

In some embodiments, the ratio (Le/L) of a distance Le between a longitudinal end of the liquid column resonance liquid chamber 18 on which the liquid common supply path 17 is disposed and the nozzle 19 closest to the longitudinal end to the length L is greater than 0.6.

In some embodiments, the liquid droplet forming unit 10 includes a plurality of liquid column resonance liquid chambers 18 in terms of productivity. The number of the liquid column resonance liquid chambers 18 per liquid droplet forming unit 10 is not limited to a particular number. As the number of the liquid column resonance liquid chambers 18 per liquid droplet forming unit 10 increases, productivity increases but operability decreases. In some embodiments, the number of the liquid column resonance liquid chambers 18 per liquid droplet forming unit 10 is 100 to 2,000 in terms of productivity and operability.

The vibration generator 20 may be formed from a piezoelectric body and an elastic plate 9 attached to each other. The elastic plate 9 may constitute a part of the wall of the liquid column resonance liquid chamber 18 so that the piezoelectric body does not contact the toner constituent liquid. The vibration generator 20 in each liquid column resonance liquid chamber 18 may be independently controllable. Alternatively, a single blockish vibrating material may be partially cut to fit the arrangement of the liquid column resonance liquid chambers 18 so that each liquid column resonance liquid chamber 18 is independently controllable through the elastic plate.

The piezoelectric body may comprise a piezoelectric ceramic such as lead zirconate titanate (PZT), a piezoelectric polymer such as polyvinylidene fluoride (PVDF), crystal, or a single crystal of $LiNbO_3$, $LiTaO_3$, or $KNbO_3$.

In some embodiments, each of the nozzles 19 has an outlet diameter of 1 to 40 μm. When the outlet diameter is less than 1 μm, the resulting liquid droplets may be too small to be used as toner particles. Moreover, in a case in which the toner constituents liquid includes solid fine particles such as pigments, the nozzles 19 may be frequently clogged. When the outlet diameter is greater than 40 μm, the resulting liquid droplets may be so large and need to be diluted with an organic solvent. Therefore, a large amount of drying energy is required when obtaining toner particles.

All the nozzles 19 may have the same outlet diameter. Alternatively, at least one nozzle 19 may have a different outlet diameter from the others.

When the outlet has a true circle shape, the diameter of the true circle is employed as the outlet diameter of the nozzle 19. When the outlet has an ellipsoidal or polygonal (e.g., tetragonal, hexagonal, octagonal) shape, the average diameter is employed as the outlet diameter of the nozzle 19.

As illustrated in FIG. 2, a plurality of the nozzles 19 may be disposed in the width direction of the liquid column resonance liquid chamber 18, which improves production efficiency.

At least one nozzle 19 is disposed within one liquid column resonance liquid chamber 18. In some embodiments, the number of the nozzles 19 per liquid column resonance liquid chamber 18 is 2 to 100 in terms of productivity. When the number of the nozzles 19 per liquid column resonance liquid chamber 18 is greater than 100, the vibration generator 20 requires a higher voltage, causing unstable behavior of the piezoelectric body.

In some embodiments, the interval between adjacent nozzles 19 is 20 μm or more. When the interval is less than 20 μm, it is likely that liquid droplets discharged from adjacent nozzles collide with each other.

FIGS. 3A to 3D are cross-sectional views of the nozzles 19 in accordance with some embodiments. The nozzles 19 are formed on a thin film 41 disposed to the end wall surface of the liquid column resonance liquid chamber 18 in a shorter direction. In an embodiment illustrated in FIG. 3A, a thin film 41 has a half-rounded cross-sectional shape such that the opening diameter of each of the nozzles 19 is gradually reduced from the liquid-contacting surface toward the outlet. In this embodiment, the thin film 41 applies the maximum pressure to the toner constituent liquid at the outlets of the nozzles 19 when vibrating.

Figure 3A:
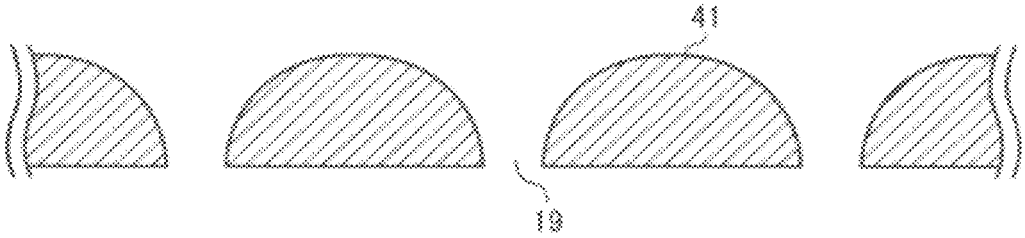
FIGS. 3A to 3D are cross-sectional views of nozzles in accordance with some embodiments.
Figure 3B:
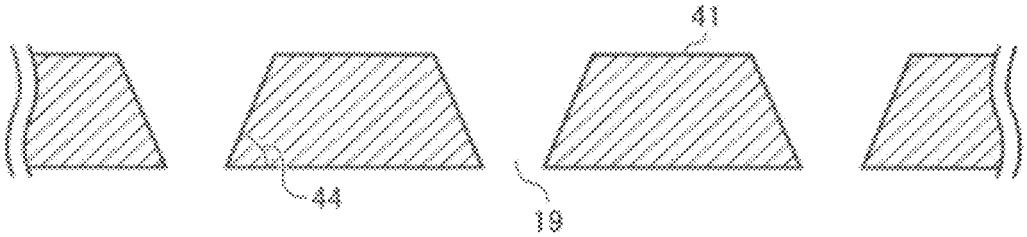
Figure 3C:
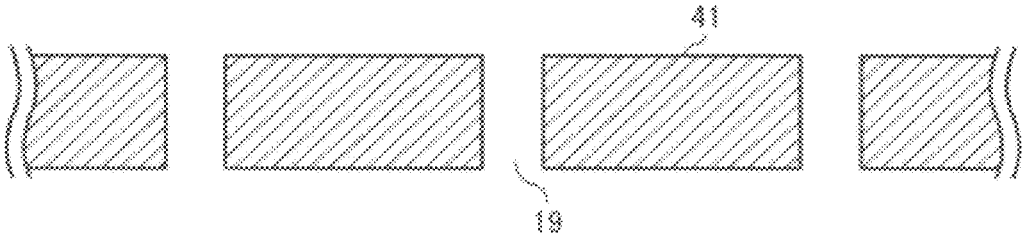
Figure 3D:
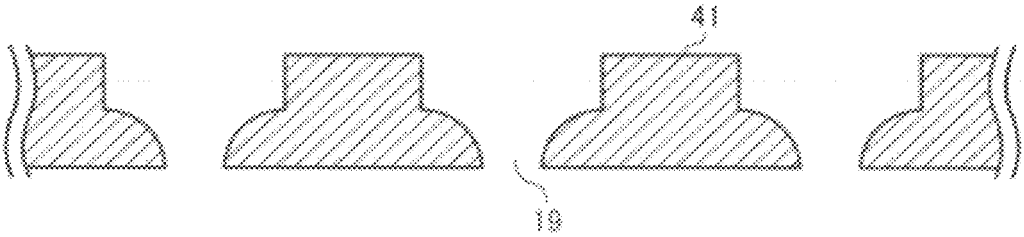

In an embodiment illustrated in FIG. 3B, thin film 41 has a quadrilateral cross-sectional shape with a predetermined nozzle angle 44 such that the opening diameter of each of the nozzles 19 is reduced at a constant rate from the liquid-contacting surface toward the outlet. In this embodiment, the thin film 41 applies the maximum pressure to the toner constituent liquid at the outlets of the nozzles 19 when vibrating. In some embodiments, the nozzle angle 44 is 60 to 90°. When the nozzle angle 44 is less than 60°, it may be difficult to apply pressure to the toner constituent liquid. It may be also difficult to form such nozzles on the thin film 41. When the nozzle angle 44 is 90° as illustrated in FIG. 3C, it may be difficult to apply pressure to the vicinities of the outlets of the nozzles 19. When the nozzle angle 44 is greater than 90°, it may be difficult to apply pressure to the outlets of the nozzles 19, resulting in significantly unstable discharge of liquid droplets. An embodiment illustrated in FIG. 3D is a combination of the embodiments illustrated in FIGS. 3A and 3B. In this embodiment, the cross-sectional shape of the thin film 41 is varied in a stepwise manner.

A mechanism of liquid droplet formation in the liquid droplet forming unit 10 is described in detail below.

First, a mechanism of liquid column resonance generated in the liquid column resonance liquid chamber 18 is described. The resonant wavelength λ is represented by the following formula (1):

$$\lambda = c/f \tag{1}$$

wherein c represents a sonic speed in the toner constituents liquid in the liquid column resonance liquid chamber 18 and f represents a drive frequency given to the toner constituents liquid from the vibration generator 20.

Referring to FIG. 1, L represents a length between the fixed end of the frame of the liquid column resonance liquid chamber 18 and the other end thereof closer to the liquid common supply path 17; h1 (e.g., 80 μm) represents a height of the end of the frame of the liquid column resonance liquid chamber 18 closer to the liquid common supply path 17; and h2 (e.g., 40 μm) represents a height of a communication opening between the liquid column resonance liquid chamber 18 and the liquid common supply path 17.

When both ends are fixed (i.e., the end closer to the liquid common supply path 17 is also closed), resonance most effectively occurs when the length L is an even multiple of λ/4. In this case, the length L is represented by the following formula (2):

$$L = (N/4)\lambda \tag{2}$$

wherein N represents an even number.

The formula (2) is also satisfied when both ends of the liquid column resonance liquid chamber 18 are completely open or free.

Similarly, when one end is open or free (so that pressure can be released) and the other end is closed or fixed, resonance most effectively occurs when the length L is an odd multiple of λ/4. In this case, the length L is represented by the formula (2) as well, wherein N represents an odd number.

Thus, the most effective drive frequency f is derived from the formulae (1) and (2) and represented by the following formula (3):

$$f = N \times c/(4L) \tag{3}$$

wherein f represents a drive frequency given to the toner constituents liquid, L represents a longitudinal length of the liquid column resonance liquid chamber 18, c represents a sonic speed in the toner constituents liquid, and N represents an even integer when both ends are closed or open and an odd integer when one end is closed.

In the present embodiment, a vibration having a frequency f derived from the formula (3) is applied to the toner constituent liquid. Actually, vibration is not infinitely amplified because the liquid attenuates resonance due to its viscosity. Therefore, resonance can occur even at a frequency around the most effective drive frequency f represented by the formula (3).

FIGS. 4A to 4D are views of wave configurations (i.e., resonant modes) of velocity and pressure standing waves when N is 1, 2, or 3. FIGS. 5A to 5C are views of wave configurations (i.e., resonant modes) of velocity and pressure standing waves when N is 4 or 5. The standing waves are longitudinal waves in actual but are illustrated as transversal waves in FIGS. 4A to 4D and FIGS. 5A to 5C for the sake of simplicity. In FIGS. 4A to 4D and FIGS. 5A to 5C, solid lines represent velocity standing waves and dotted lines represent pressure standing waves.

Figure 4A:
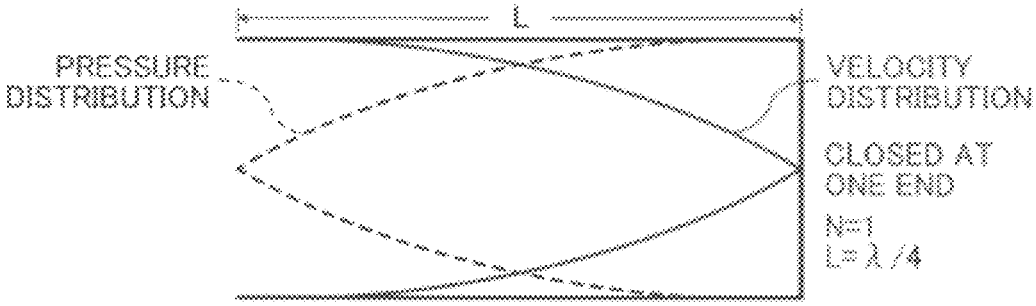
FIGS. 4A to 4D are views of wave configurations (i.e., resonant modes) of velocity and pressure standing waves when N is 1, 2, or 3.
Figure 4B:
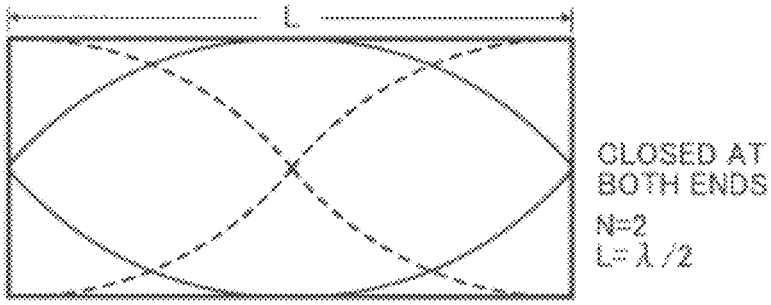
Figure 4C:
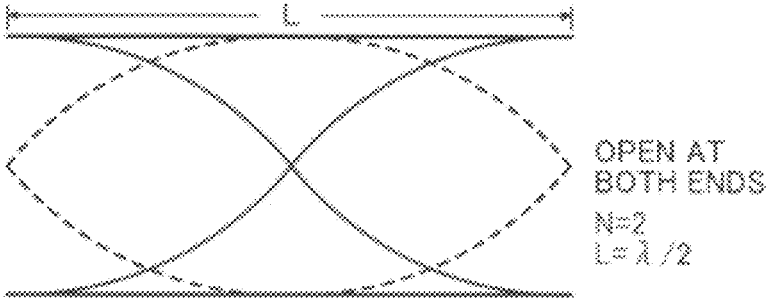
Figure 4D:
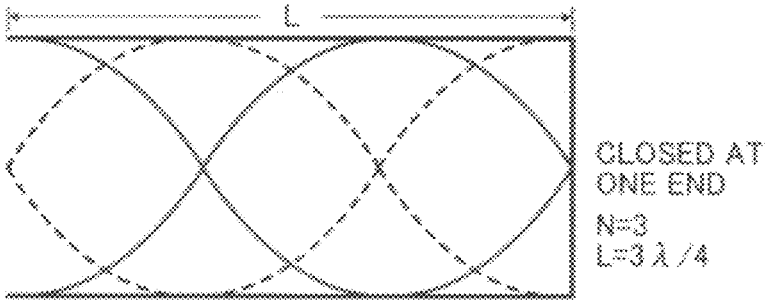
Figure 5A:
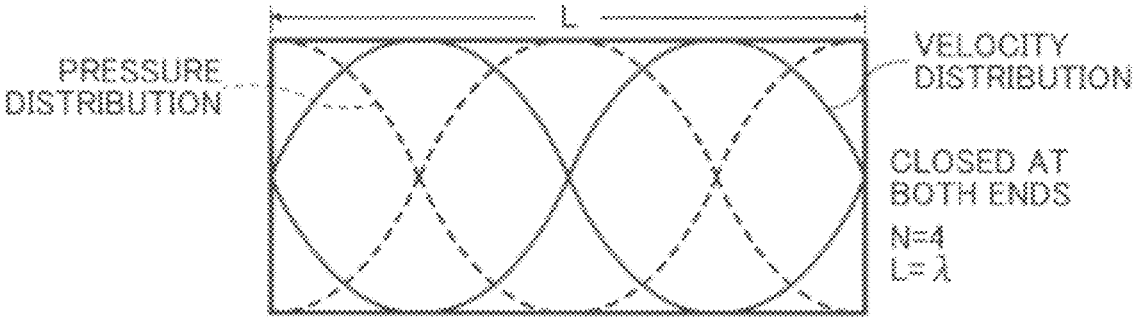
FIGS. 5A to 5C are views of wave configurations (i.e., resonant modes) of velocity and pressure standing waves when N is 4 or 5.
Figure 5B:
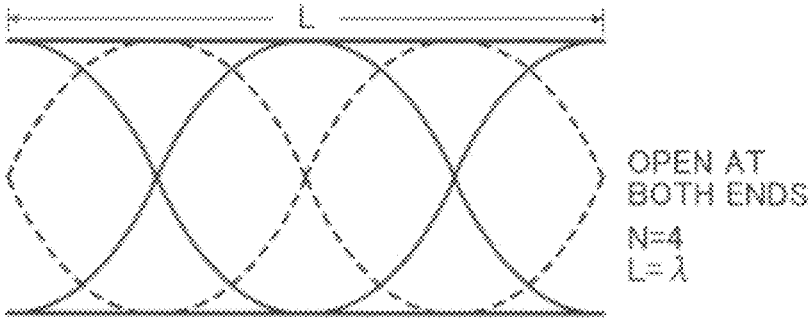
Figure 5C:
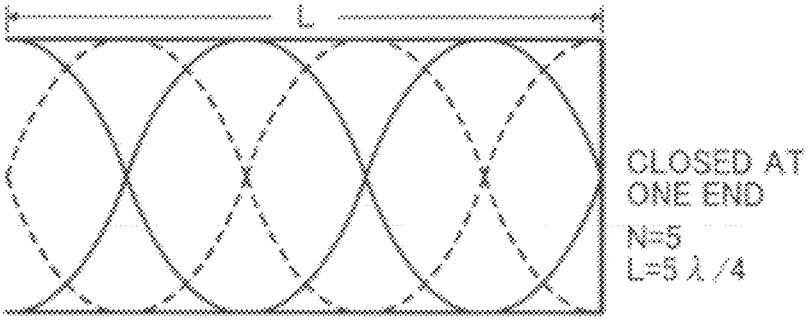

Resonant standing waves as illustrated in FIGS. 4A to 4D and FIGS. 5A to 5C occur when each end is ideally completely closed or open. Referring to FIG. 4A, when one end is closed and N is 1, amplitude of the velocity standing wave is zero at the closed end and is maximum at the open end.

In acoustics, an open end is defined as a point at which longitudinal velocity of a medium (e.g., a liquid) is maximum and pressure thereof is zero. A closed end is defined as a point at which longitudinal velocity of the medium is zero. The closed end is acoustically considered as a hard wall that reflects waves.

Configurations of standing waves vary depending on the number, arrangement, and/or cross-sectional shape of the nozzles. Thus, resonant frequency can appear even at a position displaced from the position derived from the formula (3). Even in such cases, stable discharge conditions can be provided by adjusting the drive frequency.

In particular, the drive frequency depends on the number, arrangement, and/or cross-sectional shape of the nozzles 19.

For example, when the sonic speed c in the liquid is 1,200 m/s, the length L between both ends of the liquid column resonance liquid chamber 18 is 1.85 mm, both ends are fixed with wall surfaces, i.e., both ends are closed, and N is 2, the most effective resonant frequency is derived from the formula (3) as 324 kHz.

As another example, when the sonic speed c in the liquid is 1,200 m/s, the length L between both ends of the liquid column resonance liquid chamber 18 is 1.85 mm, both ends are fixed with wall surfaces, i.e., both ends are closed, and N is 4, the most effective resonant frequency is derived from the formula (3) as 648 kHz. Higher resonance can occur in the single liquid column resonance liquid chamber 18.

As another example, as the number of the nozzles 19 increases, closed ends of the liquid column resonance liquid chamber 18 are gradually released from restriction. As a result, a resonant standing wave is generated as if both ends are substantially open and the drive frequency is increased. As another example, when each of the nozzles 19 has a round cross-sectional shape or the volume of each nozzle 19 is varied by varying the frame thickness, the actual drive frequency is varied. A liquid column resonant standing wave can generate even at a frequency around the most effective drive frequency for generating a resonant standing wave. When the vibration generator 20 vibrates at a drive frequency f satisfying the following formulae (4) and (5), a liquid column resonance is generated and liquid droplets are discharged from the nozzles 19:

$$N\times c/(4L)\leq f\leq N\times c/(4Le) \quad (4)$$

$$N\times c/(4L)\leq f\leq (N+1)\times c/(4Le) \quad (5)$$

wherein L represents a length between both longitudinal ends of the liquid column resonance liquid chamber 18 and Le represents a distance between a longitudinal end of the liquid column resonance liquid chamber 18 closer to the liquid common supply path 17 and the nozzle 19 closest to the longitudinal end.

The formula (4) is applied when both ends are open. The formula (5) is applied when one end is open the other end is closed.

Details of liquid column resonance generated in the liquid column resonance liquid chamber 18 are described with reference to FIGS. 6A to 6D. In FIGS. 6A to 6D, solid lines represent velocity distributions at arbitrary points within the liquid column resonance liquid chamber 18. With respect to velocity, the direction from the liquid common supply path 17 side toward the liquid column resonance liquid chamber 18 is defined as the plus (±) direction and the opposite direction is defined as the minus (−) direction. Dotted lines represent pressure distributions at arbitrary points within the liquid column resonance liquid chamber 18. A positive (+) pressure and a negative (−) pressure relative to atmospheric pressure respectively create downward and upward pressures in FIGS. 6A to 6D. In FIGS. 6A to 6D, a height (equivalent to h1 in FIG. 1) of the end of the frame of the liquid column resonance liquid chamber 18 closer to the liquid common supply path 17 is twice as much as a height (equivalent to h2 in FIG. 1) of the communication opening between the liquid column resonance liquid chamber 18 and the liquid common supply path 17, which can be assumed that both ends of the liquid column resonance liquid chamber 18 are approximately closed. Thus, FIGS. 6A to 6D represent temporary variations in velocity and pressure distributions under the assumption that both ends of the liquid column resonance liquid chamber 18 are approximately closed.

Figure 6A:
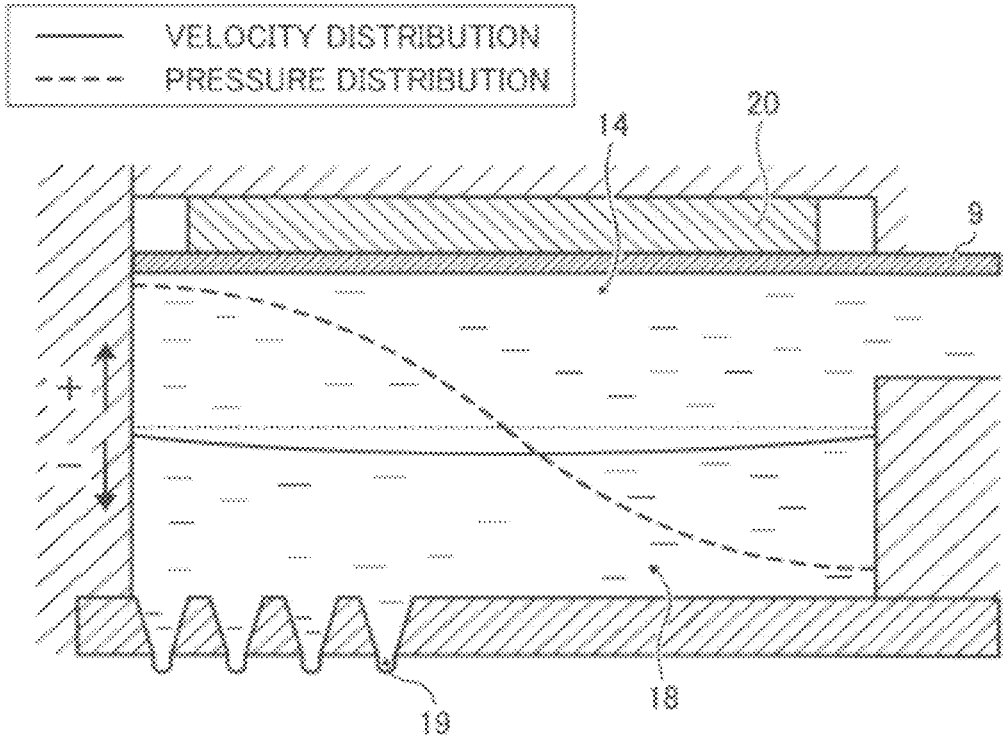
FIGS. 6A to 6D are views of velocity and pressure distributions at arbitrary points within a liquid column resonance liquid chamber according to an embodiment.
Figure 6B:
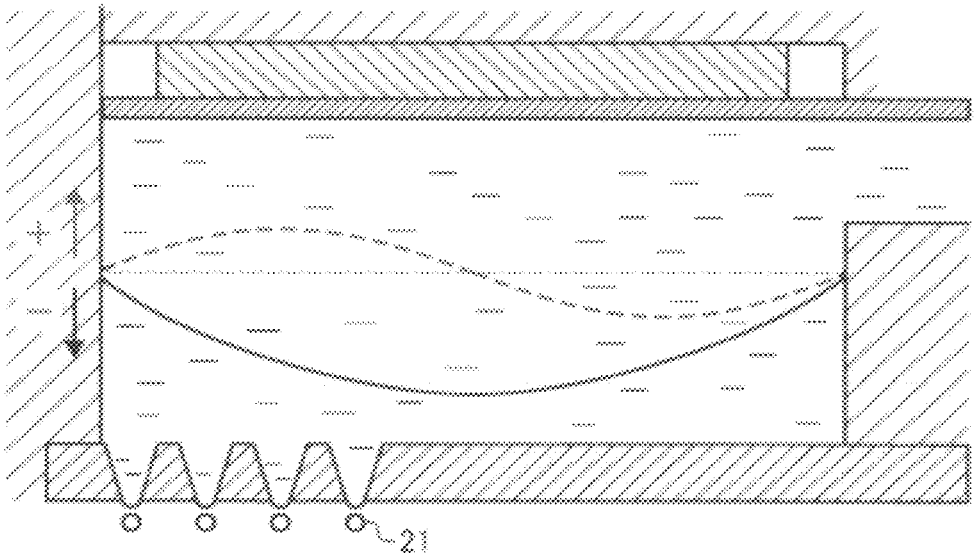

In FIG. 6A, pressure and velocity wave configurations immediately before discharging of liquid droplets from the liquid column resonance liquid chamber 18 are illustrated. Within the liquid column resonance liquid chamber 18, the pressure gradually increases at the position where the nozzles 19 are disposed. Thereafter, as illustrated in FIG. 6B, the positive pressure around the nozzles 19 decreases toward negative pressures so as to start discharging liquid droplets 21.

Figure 6C:
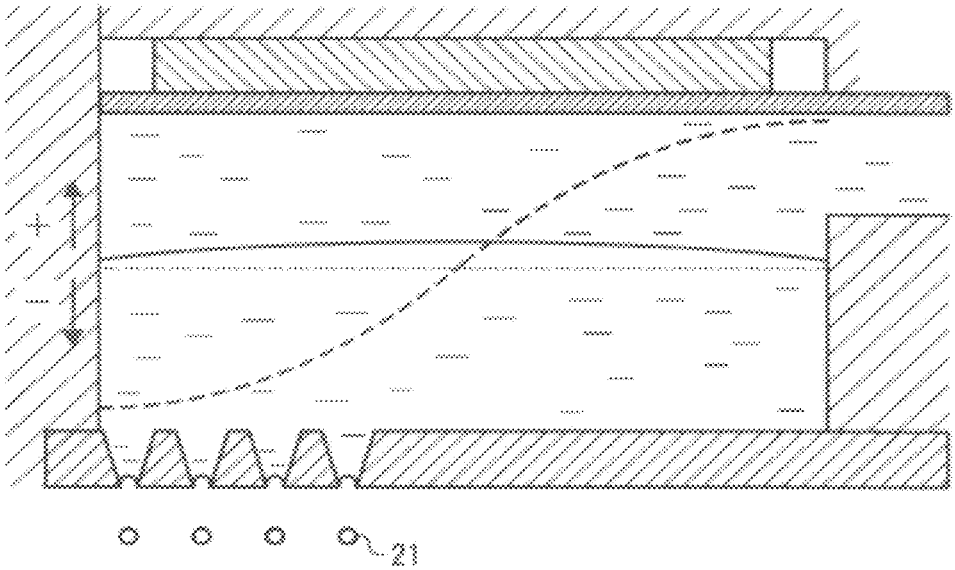
Figure 6D:
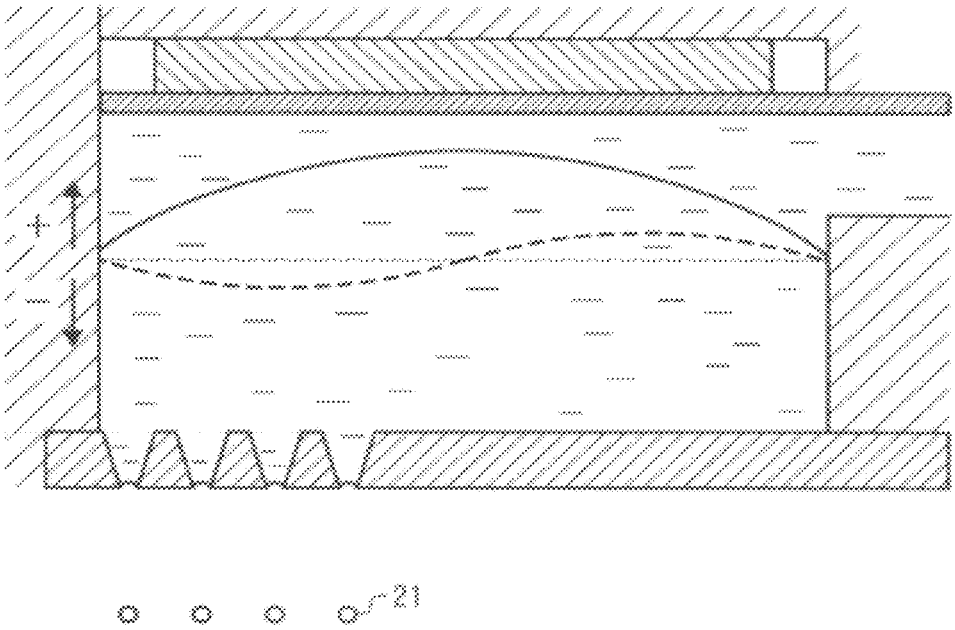

Thereafter, as illustrated in FIG. 6C, the pressure around the nozzles 19 becomes minimum. From this time, filling the liquid column resonance liquid chamber 18 with the toner constituents liquid 14 is started. Thereafter, as illustrated in FIG. 6D, the negative pressure around the nozzles 19 increases toward positive pressures. At this time, filling the liquid column resonance liquid chamber 18 with the toner constituents liquid 14 is terminated. Thereafter, as illustrated in FIG. 6A, the pressure within the liquid column resonance liquid chamber 18 becomes maximum again at the position where the nozzles 19 are disposed so as to start discharging liquid droplets 21 again.

In summary, a standing wave is generated in liquid column resonance caused by a high-frequency driving of the generation vibrator 20 within the liquid column resonance liquid chamber 18. The nozzles 19 are disposed to the position corresponding to antinodes of the standing wave at which the pressure amplitude becomes maximum so that the toner liquid droplets 21 are continuously discharged from the nozzles 19 in accordance with the period of the standing wave.

In one embodiment, the length L between both longitudinal ends of the liquid column resonance liquid chamber 18 is 1.85 mm, the resonant mode N is 2, the first to fourth nozzles are disposed to the position corresponding to antinodes of the pressure standing wave, and the drive wave is a sine wave having a drive frequency of 340 kHz.

Figure 7:
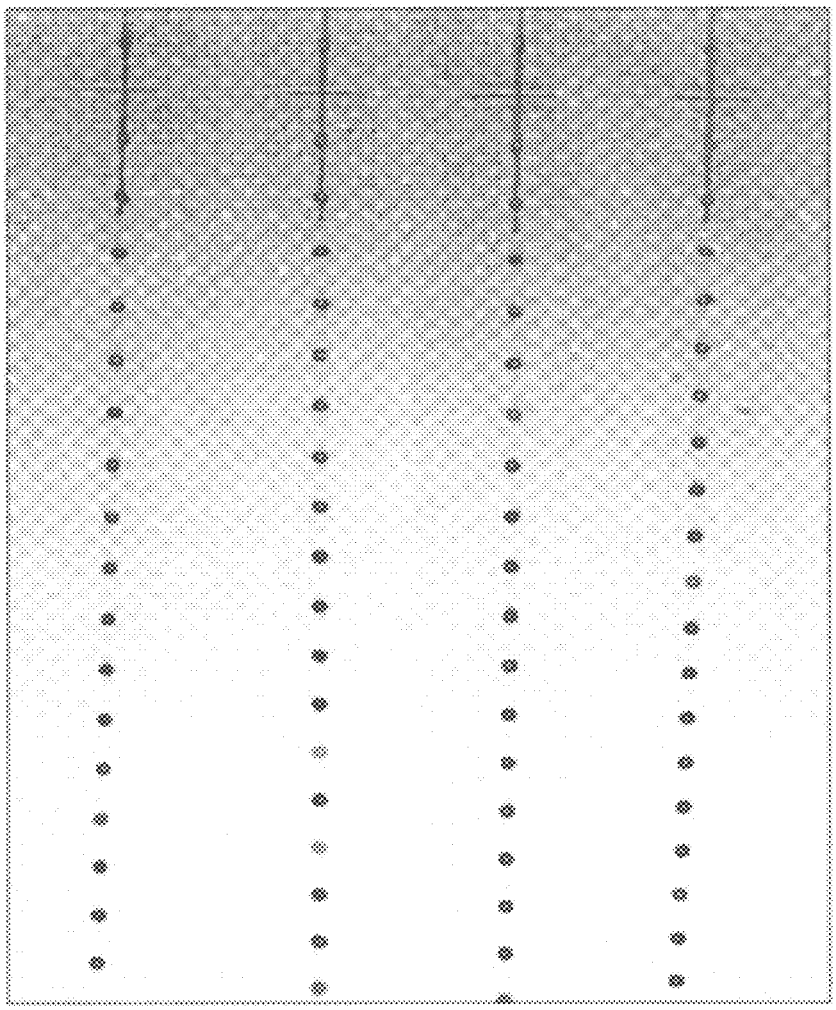
FIG. 7 is a photograph showing liquid droplet discharge phenomenon according to an embodiment obtained by a laser shadowgraphy.
Figure 8:
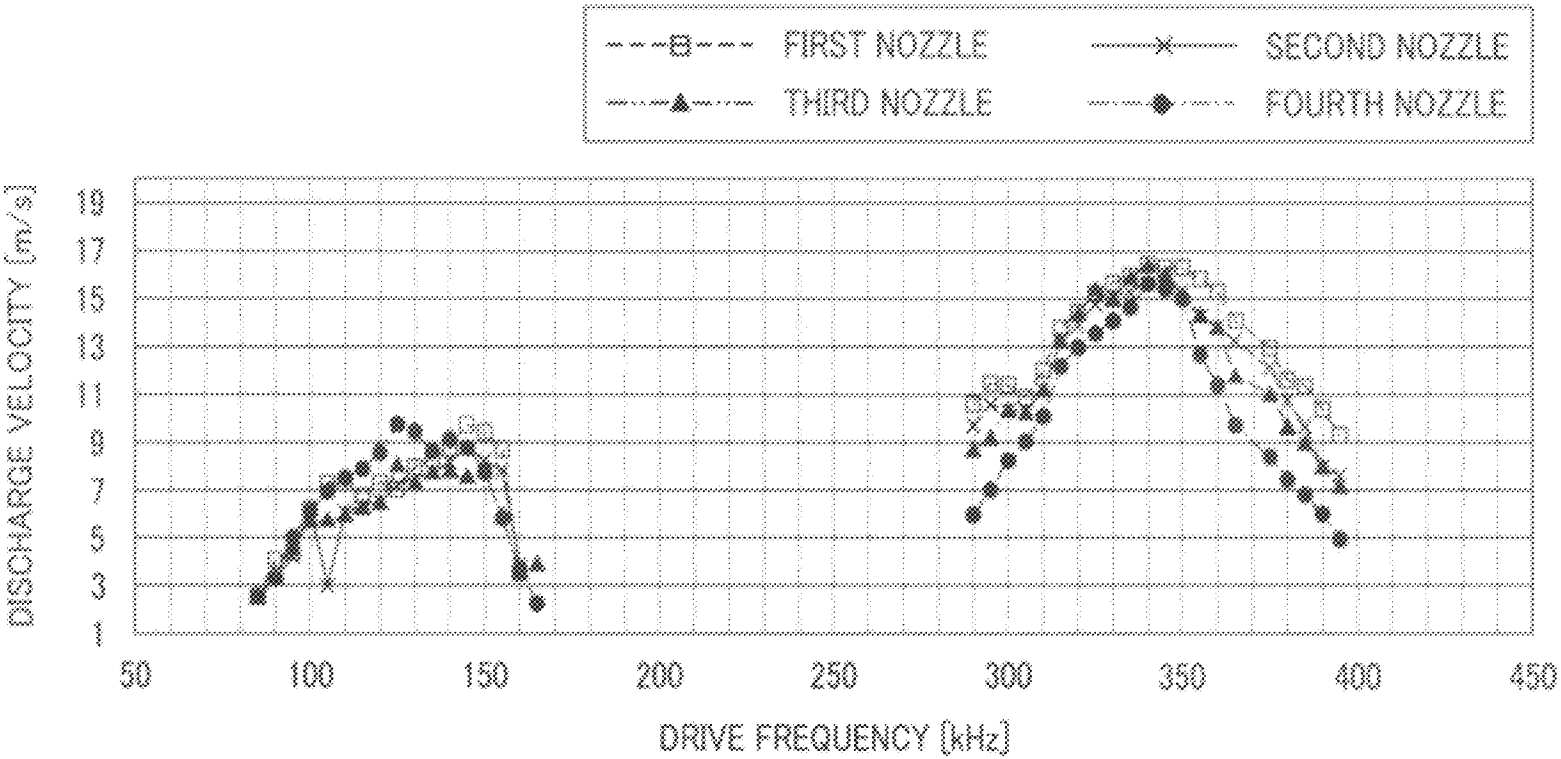
FIG. 8 is a graph showing relations between drive frequency and discharge velocity.

FIG. 7 is a photograph showing liquid droplet discharge phenomenon according to this embodiment obtained by a laser shadowgraphy. It is clear from FIG. 7 that the discharged liquid droplets are very uniform in size and the discharge velocity is constant. FIG. 8 is a graph showing relations between drive frequency and discharge velocity when the drive wave is sine waves having a driving frequency between 290 and 395 kHz with the same amplitude. It is clear from FIG. 8 that the discharge velocities at all the first to fourth nozzles become maximum and uniform when the drive frequency is around 340 kHz. Accordingly, it is clear that the liquid droplet discharge phenomenon occurs at the position corresponding to antinodes of the standing wave having a frequency of 340 kHz, which is the second resonant mode of liquid column resonance. It is also clear from FIG. 8 that the liquid droplet discharge phenomenon does not occur between the first resonant mode around drive frequencies of 130 kHz and the second resonant mode around drive frequencies of 340 kHz.

Figure 9:
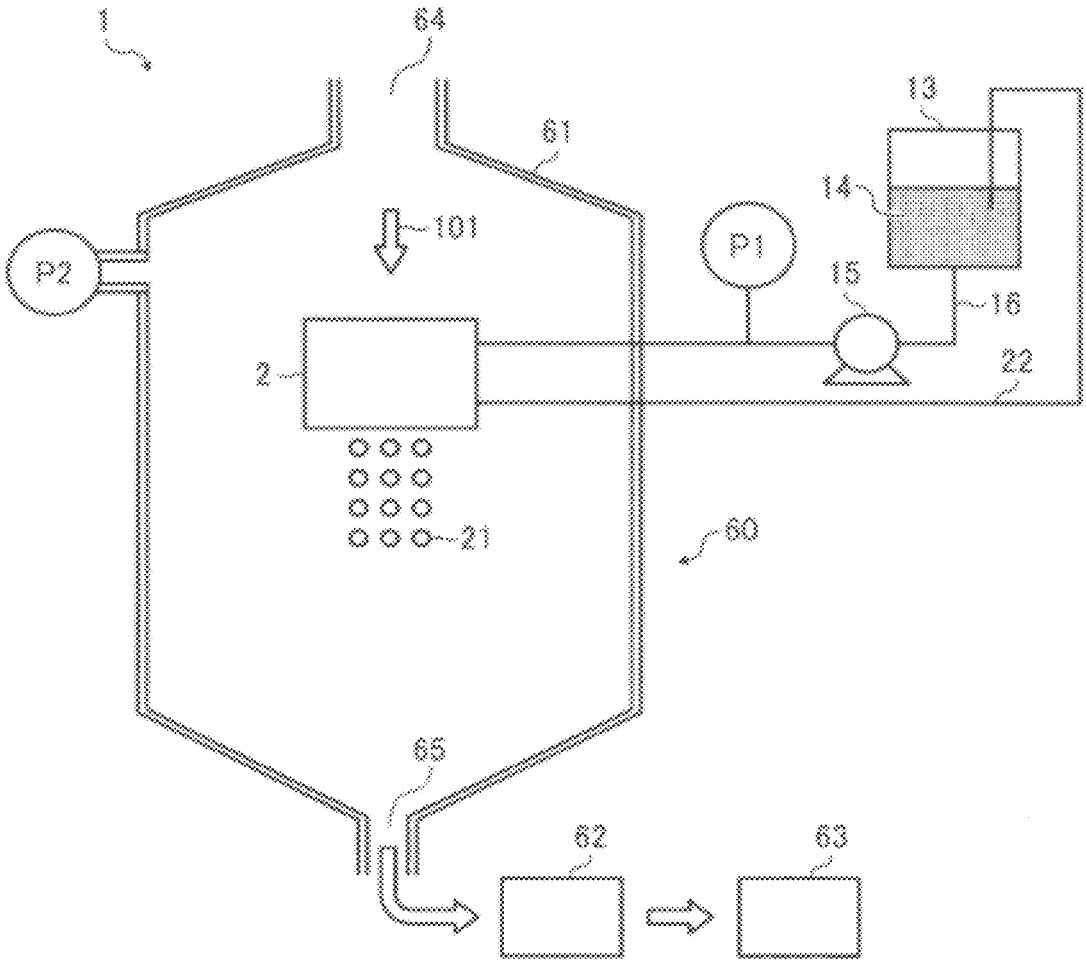
FIG. 9 is a schematic view of a toner manufacturing apparatus according to an embodiment.

FIG. 9 is a schematic view of a toner manufacturing apparatus according to an embodiment. A toner manufacturing apparatus 1 has a liquid droplet discharge unit 2 and a drying collecting unit 60. The liquid droplet discharge unit 2 may comprise the liquid droplet forming unit 10 described above.

The liquid droplet discharge unit 2 is connected to a raw material container 13 and a liquid circulating pump 15. The raw material container 13 contains a toner constituents liquid 14. The liquid circulating pump 15 supplies the toner constituents liquid 14 from the raw material container 13 to the liquid droplet discharge unit 2 through a liquid supply pipe 16. Also, the liquid circulating pump 15 pumps the toner constituents liquid 14 in the liquid supply pipe 16 and returns it to the raw material container 13 through a liquid return pipe 22. It is possible to continually supply the toner constituents liquid 14 to the liquid droplet discharge unit 2.

The liquid supply pipe 16 and the drying collecting unit 60 are equipped with pressure gauges P1 and P2, respectively. The pressure gauges P1 and P2 monitor the liquid feed pressure toward the liquid droplet discharge unit 2 and the inner pressure of the drying collecting unit 60, respectively. In some embodiments, P1 nearly equals P2. When P1>P2, the toner constituents liquid 14 may leak from nozzles. When P1<P2, liquid droplet discharge phenomenon may be stopped due to immersion of gas to the liquid droplet discharge unit 2.

The drying collecting unit 60 has a chamber 61, a toner collecting part 62, and a toner storing part 63. Liquid droplets 21 of the toner constituents liquid 14 are in a liquid state immediately after being discharged from the liquid droplet discharge unit 2. The liquid droplets 21 gradually transit from a liquid state to a solid state as volatile solvents are volatilized while being conveyed within the chamber 61. Droplets in a solid state do not coalesce with each other even when brought into contact with each other. The toner collecting part 62 collects toner particles in a solid state. The toner particles are stored in the toner storing part 63. The toner particles stored in the toner storing part 63 are further subjected to drying, if needed.

Within the chamber 61, a descending conveyance air current 101 is formed through a conveyance air current inlet 64. The liquid droplets 21 discharged from the liquid droplet discharge unit 2 are conveyed downward in a vertical direction by the actions of gravity as well as the conveyance air current 101. Thus, the liquid droplets 21 are prevented from decelerating by air resistance. Even when liquid droplets 21 are continuously discharged, preceding liquid droplets are prevented from decelerating by air resistance and coalescing with subsequent liquid droplets. In the present embodiment, the liquid droplet discharge unit 2 discharges the liquid droplets 21 downward in a vertical direction, but the discharge direction is not limited to a vertical direction is arbitrary. The conveyance air current 101 may be generated by applying pressure to the chamber 61 from the conveyance air current inlet 64 by an air blower or sucking the chamber 61 from a conveyance air current outlet 65. The toner collecting part 62 may comprise a cyclone collector or a back filter, for example.

The conveyance air current 101 may be, for example, laminar flow, swirl flow, or turbulent flow. The conveyance air current 101 may be formed of, for example, air or a noncombustible gas such as nitrogen. The conveyance air current 101 is adapted to accelerate drying of the liquid droplets 21 so that the liquid droplets 21, in a liquid state, are prevented from coalescing with each other. Thus, the conveyance air current 101 does not include vapors of the solvents included in the toner constituents liquid 14. The temperature of the conveyance air current 101 may be arbitrary and constant. The chamber 61 may further include a unit for changing the condition of the conveyance air current 101. The conveyance air current 101 is also adapted to prevent the liquid droplets 21 from adhering to the chamber 61.

As described above, coalescence of the liquid droplets 21 is prevented by the action of the conveyance air current 101. Coalescence of the liquid droplets 21 can be also prevented by generating an auxiliary conveyance air current at the vicinity of the liquid droplet discharge unit 2, charging the liquid droplets 21 to the same polarity, or controlling electric field.

Figure 10:
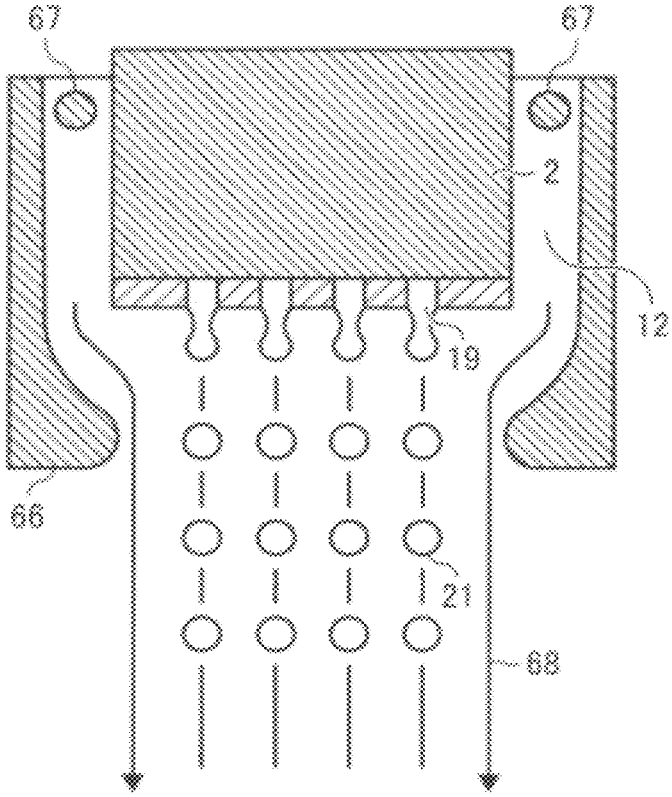
FIG. 10 is a schematic view of a coalescence preventing unit using an auxiliary conveyance air current according to an embodiment.

FIG. 10 is a schematic view of a coalescence preventing unit using an auxiliary conveyance air current according to an embodiment. A shroud 66 is disposed around the liquid droplet discharge unit 2 and an auxiliary conveyance air current inlet 67 is disposed at a part of the shroud 66. A gas is introduced from the auxiliary conveyance air current inlet 67 into an airflow pathway 12 defined by the shroud 66. Thus, an auxiliary conveyance air current 68 is formed at the vicinity of the nozzles 19. The liquid droplets 21 discharged from the liquid droplet discharge unit 2 moves without decelerating by the action of the auxiliary conveyance air current 68. Therefore, the liquid droplets 21 can be prevented from coalescing with each other. The velocity of the auxiliary conveyance air current 68 may be same as or greater than that of the liquid droplets 21 immediately after being discharged from the liquid droplet discharge unit 2.

In the embodiment illustrated in FIG. 10, the auxiliary conveyance air current 68 and the liquid droplets 21 proceed in the same direction. In some embodiments, the auxiliary conveyance air current 68 and the liquid droplets 21 each proceed in a different direction.

The shroud 66 may have a shape such that its opening diameter is reduced at the vicinity of the nozzles 19 of the liquid droplet discharge unit 2 to control velocity of the air current, as illustrated in FIG. 10, but the opening diameter is not necessarily reduced. The auxiliary conveyance air current 68 may be formed of, for example, air or a noncombustible gas such as nitrogen.

Figure 11:
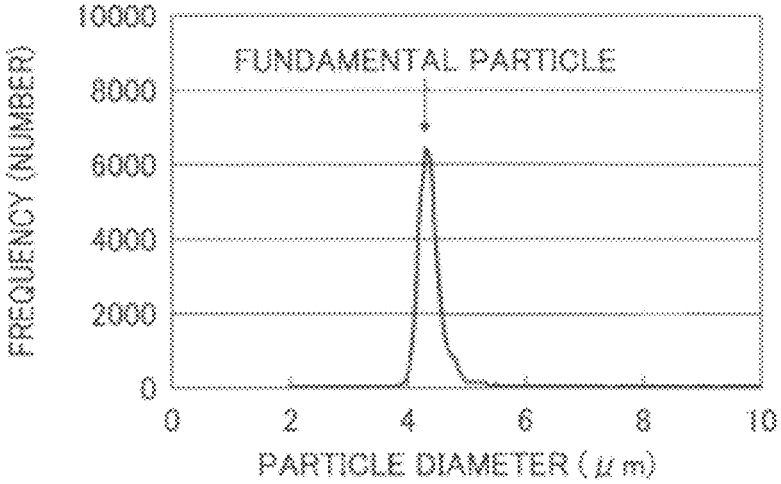
FIG. 11 is a graph showing a particle size distribution of toner particles produced by a method according to an embodiment.

FIG. 11 is a graph showing a particle size distribution of toner particles produced by a method according to an embodiment. The particle size distribution is measured by a flow particle image analyzer FPIA-3000 (from Sysmex Corporation). It is clear from FIG. 11 that the toner particles have a narrow particle size distribution. This indicates that the liquid droplets 21 are not coalesced with each other before being dried.

Figure 12:
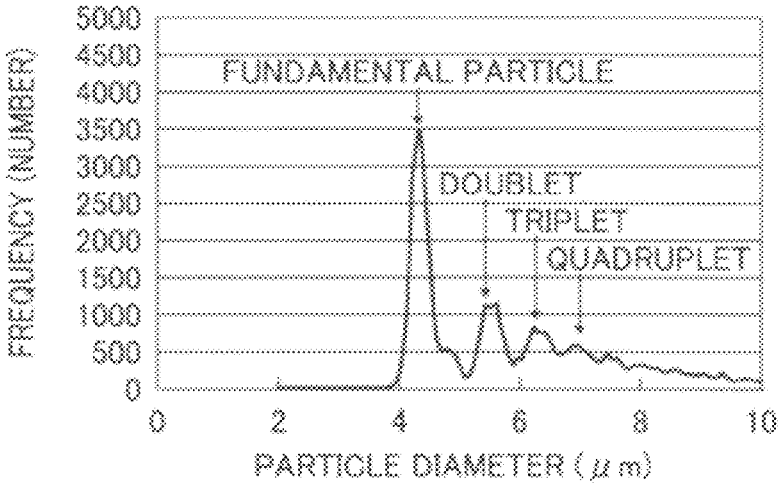
FIG. 12 is a graph showing a particle size distribution of toner particles produced in the same manner as those in accordance with FIG. 11 except that conveyance air current and auxiliary conveyance air current are not formed.
Figure 13:
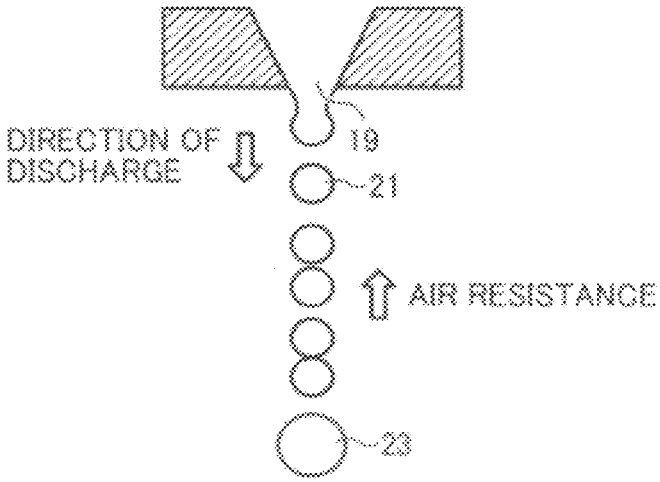
FIG. 13 is a schematic view for explaining production process of toner particles in accordance with FIG. 12.
Figure 14A:
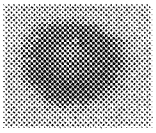
FIGS. 14A to 14D are photographs of the fundamental particle and coalesced particles.
Figure 14B:
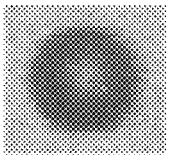
Figure 14C:
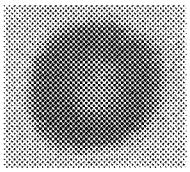
Figure 14D:
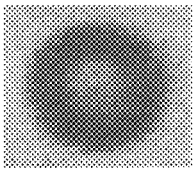

FIG. 12 is a graph showing a particle size distribution of toner particles produced in the same manner as those in accordance with FIG. 11 except that the conveyance air current 101 and auxiliary conveyance air current 68 are not formed. FIG. 13 is a schematic view for explaining production process of toner particles in accordance with FIG. 12. The liquid droplets 21 discharged from the nozzles 19 fall by the gravity while rapidly decelerating due to air resistance. As the velocity of the liquid droplets 21 decreases, the distance between the liquid droplets 21 is shortened and adjacent liquid droplets coalesce into a coalesced particle 23. The coalesced particle 23 receives a greater air resistance and is not likely to dry rapidly. Therefore, the coalesced particle 23 may further coalesce with another liquid droplet. As a result, the resulting toner particles have a wide size distribution. In FIG. 12, a fundamental particle peak is comprised of solid particles obtained when liquid droplets 21 which have not been coalesced are dried. A doublet peak is comprised of solid particles obtained when doubly-coalesced liquid droplets 21 are dried. Triplet and quadruplet peaks are comprised of solid particles obtained when triply- and quadruply-coalesced liquid droplets 21 are dried.

Figure 15A:
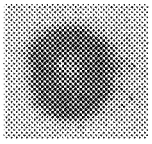
FIGS. 15A to 15C are photographs of the fundamental particle and combined particles.
Figure 15B:
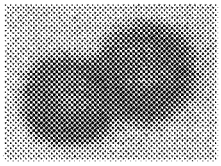
Figure 15C:
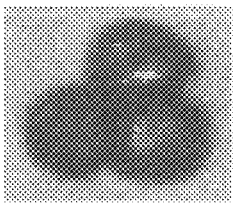

FIGS. 14A to 14D are photographs of the fundamental particle and coalesced particles. FIGS. 15A to 15C are photographs of the fundamental particle and combined particles. In a combined particle, multiple fundamental particles are bound to each other. The combined particle does not divide into fundamental particles even when mechanical impact is made thereon. Thus, the combined particle behaves similarly to a large-diameter particle, which is not preferable. The combined particle is obtained when two droplets which have been dried to some extent bind with each other, followed by drying. More specifically, when multiple droplets which have been dried to some extent accumulate on a wall surface of a piping and bind with each other, followed by drying, solid combined particles are released from the piping and collected. Generation of combined particles can be prevented by rapidly and reliably drying the liquid droplets 21 or controlling air current.

Particle size distribution is determined from the ratio (Dv/Dn) of the volume average particle diameter (Dv) to the number average particle diameter (Dn). The minimum value for Dv/Dn is 1.0. When Dv/Dn is 1.0, it means that all particles have the same size. As Dv/Dn increases, the particle size distribution gets wider. Related-art pulverization toners may have a Dv/Dn of 1.15 to 1.25. Related-art polymerization toners may have a Dv/Dn of 1.10 to 1.15. In some embodiments, toner particles obtained by the method has a Dv/Dn of 1.15 or less or 1.10 or less, which is advantages in terms of printing quality in electrophotography.

When toner particles collected in the drying collecting unit 60 contain a large amount of residual solvent, the toner particles may be optionally subjected to a secondary drying. The secondary drying may be performed by, for example, a fluidized-bed dryer or a vacuum dryer. If toner particles contain residual solvent, toner properties such as heat-resistant storage stability, fixability, and chargeability may deteriorate. Moreover, when such toner particles are fixed on a recording material by application of heat, the solvent may volatilize and adversely affect users and peripheral devices.

Toner particles obtained by a method or apparatus according to some embodiments have a very sharp particle size distribution. Such toner particles have uniform chargeability and therefore reliably produce images.

The toner constituents liquid for use in a method according to an embodiment includes a binder resin and a charge controlling agent including a polycondensation product of a phenol with an aldehyde. The toner constituents liquid may further include a colorant, a release agent, and a magnetic material. The resulting toner particles may include functional fine particles which improve fluidity or cleanability.

Toner particles obtained by a method according to an embodiment using a toner constituents liquid comprising a binder resin and a charge controlling agent including a polycondensation product of a phenol with an aldehyde, such as a metal complex of an alkyl derivative of salicylic acid, have excellent chargeability. Additionally, the toner particles have non-spherical shapes, which is advantageous in terms of blade cleanability.

It is confirmed by a surface analysis of the toner particles by a time-of-flight secondary ion mass spectrometer (TOF-SIMS) that as the added amount of the charge controlling agent comprising the polycondensation product of a phenol with an aldehyde increases, the charge controlling agent is more likely to localize at the surfaces of the toner particles. As the amount of the charge controlling agent present at the surfaces of the toner particles increases, chargeable also increases.

Because the charge controlling agent is localized at the surfaces of the toner particles, the charge controlling agent are dominantly dried. The binder resins present inside the toner particles are dried thereafter. As a result, concavities are formed on the surfaces of the toner particles.

Such non-spherical toner particles having surface concavities are effectively prevented from slipping through a cleaning member when remaining on an electrostatic latent image bearing member and being removed therefrom.

A polycondensation product of a phenol with an aldehyde is negatively chargeable.

The phenol may be, for example, a phenol compound having one phenolic hydroxyl group and a hydrogen atom bound to the ortho position with respect to the hydroxyl group, such as p-alkylphenol, p-aralkylphenol, p-phenylphenol, or p-hydroxybenzoate ester. The aldehyde may be, for example, paraformaldehyde, formaldehyde, paraldehyde, or furfural.

A commercially-available charge controlling agent including an FCA-N type condensed polymer (available from Fujikura Kasei Co., Ltd.) can be used.

The charge controlling agent may further include the following charge controlling agents: nigrosine dyes, triphenylmethane dyes, chromium-containing metal complex dyes, chelate pigments of molybdic acid, Rhodamine dyes, alkoxyamines, quaternary ammonium salts, alkylamides, phosphor and phosphor-containing compounds, tungsten and tungsten-containing compounds, fluorine activators, metal salts of salicylic acid, and metal salts of salicylic acid derivatives. Usable commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LR1-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

The charge controlling agent including a polycondensation product of a phenol with an aldehyde can be prepared by, for example, reacting a phenol with an aldehyde for 3 to 20 hours in an organic solvent (e.g., xylene) in the presence of a strong base (e.g., an alkaline metal, an alkaline-earth metal) at a temperature between 80° C. and the boiling point of the organic solvent or between 100° C. and the boiling point of the organic solvent while removing produced water. Thereafter, the reaction product is recrystallized with a poor solvent such as an alcohol or washed with an alcohol (e.g., methanol, ethanol, isopropanol) after the organic solvent is evaporated by reducing pressure. The strong base may be, for example, sodium hydroxide, rubidium hydroxide, or potassium hydroxide.

In some embodiments, the content of the charge controlling agent in the toner is 0.1 to 10% by weight. When the content of the charge controlling agent is within the above range, the toner provides better chargeability. When the content of the charge controlling agent is greater than 10%, fixability of the toner may be poor. When the content of the charge controlling agent is less than 0.1%, chargeability of the toner may be poor.

In a method in which a toner constituents liquid is discharged into liquid droplets and dried, it is likely that the resulting particles have spherical shapes because the solvent is uniformly evaporated from the liquid droplets. When the toner constituents liquid includes a polycondensation product of a phenol with an aldehyde, however, the resulting particles have non-spherical shapes due to variation in drying speed or localization condition of toner constituents in the liquid droplets.

Specific examples of usable binder resins include, but are not limited to, vinyl homopolymers and copolymers of styrene monomers, acrylic monomers, and/or methacrylic monomers, polyester resins, polyol resins, phenol resins, polyurethane resins, polyamide resins, epoxy resins, xylene resins, terpene resins, coumarone indene resins, polycarbonate resins, and petroleum resins. In some embodiments, polyester resins or styrene-acrylic or styrene-methacrylic copolymers are used.

A polyester resin may be formed from an alcohol and an acid.

Specific examples of usable divalent alcohols include, but are not limited to, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained from a reaction between a cyclic ether (e.g., ethylene oxide, propylene oxide) and bisphenol A.

Specific examples of usable acids include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenylsuccinic acid, fumaric acid, mesaconic acid), and unsaturated dibasic acid anhydrides (e.g., maleic acid anhydride, citraconic acid anhydride, itaconic acid anhydride, alkenylsuccinic acid anhydride). Additionally, tri- or more valent carboxylic acids such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, enpol trimmer acid, and anhydrides and partial lower alkyl esters of these compounds, are also usable.

Specific examples of usable styrene monomers include, but are not limited to, styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof.

Specific examples of usable acrylic monomers include, but are not limited to, acrylic acids and esters thereof such as methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Specific examples of usable methacrylic monomers include, but are not limited to, methacrylic acids and esters thereof such as methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate.

The vinyl homopolymers and copolymers are obtained using a polymerization initiator. Specific examples of usable polymerization initiators include, but are not limited to, 2,2'-azobis isobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobis isobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides (e.g., methyl ethyl ketone peroxide, acetyl acetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxy-2-ethyl hexylate, tert-butyl peroxylaurate, tert-butyl-oxybenzoate, tert-butyl peroxyisopropyl carbonate, di-tert-butyl peroxyisophthalate, tert-butyl peroxyallyl carbonate, isoamyl peroxy-2-ethyl hexanoate, di-tert-butyl peroxyhexahydroterephthalate, and tert-butyl peroxyazelate.

In some embodiments, the binder resin has a glass transition temperature (Tg) of 35 to 80° C. or 40 to 75° C. in view of storage stability of the toner. When Tg is less than 35° C., the toner may easily deteriorate in high-temperature atmosphere. When Tg is greater than 80° C., the toner may have poor fixability.

The toner including a colorant is adapted to produce colors on paper or image carriers. The toner including no colorant is adapted to improve image gloss or to protect image.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

In some embodiments, the content of the colorant in the toner is 1 to 15% by weight or 3 to 10% by weight.

The colorant can be combined with a resin to be used as a master batch. Specific examples of usable resin for the master batch include, but are not limited to, polyester resins, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

The master batch can be obtained by mixing and kneading a resin and a colorant while applying a high shearing force. To increase the interaction between the colorant and the resin, an organic solvent can be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill can be preferably used.

In some embodiments, the content of the master batch is 2 to 30 parts by weight based on 100 parts by weight of the binder resin.

In some embodiments, the resin for the master batch has an acid value of 30 mgKOH/g or less and an amine value of 1 to 100 mgKOH/g. In some embodiments, the resin for the master batch has an acid value of 20 mgKOH/g or less and an amine value of 10 to 50 mgKOH/g. When the acid value is greater than 30 mgKOH/g, chargeability and colorant dispersibility may be poor under high-humidity conditions. When the amine value is less than 1 mgKOH/g or greater than 100 mgKOH/g, colorant dispersibility may be poor. Acid value can be measured based on a method according to JIS K0070. Amine value can be measured based on a method according to JIS K7237.

In some embodiments, a colorant dispersant can be used in combination with the colorant. Usable colorant dispersants may have high compatibility with the binder resin. For example, commercially available colorant dispersants such as AJISPER PB821 and PB822 (from Ajinomoto Fine-Techno Co., Inc.), DISPERBYK-2001 (from BYK-Chemie GmbH), and EFKA-4010 (from EFKA) are usable.

In some embodiments, the colorant dispersant has a weight average molecular weight of 500 to 100,000, 3,000 to 100,000, 5,000 to 50,000, or 5,000 to 30,000. The weight average molecular weight is determined from a maximum peak in a styrene-conversion molecular weight distribution obtained by gel permeation chromatography. When the weight average molecular weight is less than 500, it means that the polarity of the dispersant is so high that colorants cannot be finely dispersed. When the molecular weight is greater than 100,000, it means that affinity of the dispersant for solvents is so high that colorants cannot be finely dispersed.

In some embodiments, the content of the colorant dispersant is 1 to 50 parts by weight or 5 to 30 parts by weight based on 100 parts by weight of the colorant. When the content is less than 1 part by weight, colorant dispersibility may be poor. When the content is greater than 50 parts by weight, chargeability of the toner may be poor.

In some embodiments, the toner includes a release agent. The release agent is adapted to prevent the occurrence of toner offset phenomenon when the toner is fixed on a recording medium.

Specific examples of usable release agents include, but are not limited to, aliphatic hydrocarbon waxes (e.g., low-molecular-weight polyethylene, low-molecular-weight polypropylene, polyolefin wax, microcrystalline wax, paraffin wax, SASOL wax), aliphatic hydrocarbon wax oxides (e.g., oxidized polyethylene wax) and block copolymers thereof, plant waxes (e.g., candelilla wax, carnauba wax, sumac wax, jojoba wax), animal waxes (e.g., bees wax, lanolin, spermaceti), mineral waxes (e.g., ozokerite, ceresin, petrolatum), waxes mainly composed of fatty acid esters (e.g., montanate wax, castor wax), and partially or completely deoxidized fatty acid esters (e.g., deoxidized carnauba wax). Specific examples of usable release agents further include, but are not limited to, saturated straight-chain fatty acids (e.g., palmitic acid, stearic acid, montanic acid, straight-chain alkylcarboxylic acids), unsaturated fatty acids (e.g., brassidic acid, eleostearic acid, parinaric acid), saturated alcohols (e.g., stearyl alcohol, eicosyl alcohol, behenyl alcohol, carnaubyl alcohol, ceryl alcohol, melissyl alcohol, long-chain alkyl alcohol), polyols (e.g., sorbitol), fatty acid amides (e.g., linoleic acid amide, olefin acid amide, lauric acid amide), saturated fatty acid bisamides (e.g., methylenebis capric acid amide, ethylenebis lauric acid amide, hexamethylenebis stearic acid amide), unsaturated fatty acid amides (e.g., ethylenebis oleic acid amide, hexamethylenebis oleic acid amide, N,N'-dioleyl adipic acid amide, N,N'-dioleyl sebacic acid amide), aromatic biamides (e.g., m-xylenebis stearic acid amide, N,N-distearyl isophthalic acid amide), metal salts of fatty acids (e.g., calcium stearate, calcium laurate, zinc stearate, magnesium stearate), aliphatic hydrocarbon waxes to which a vinyl monomer such as styrene and an acrylic acid is grafted, partial ester compounds of a fatty acid with a polyol (e.g., behenic acid monoglyceride), and methyl ester compounds having a hydroxyl group obtained by hydrogenating plant fats.

Specific examples of usable release agents further include, but are not limited to, a polyolefin obtained by radical polymerizing an olefin under high pressure; a polyolefin obtained by purifying low-molecular-weight byproducts of a high-molecular-weight polyolefin; a polyolefin polymerized under low pressures in the presence of a Ziegler catalyst or a metallocene catalyst; a polyolefin polymerized using radiation, electromagnetic wave, or light; a low-molecular-weight polyolefin obtained by thermally decomposing a high-molecular-weight polyolefin; paraffin wax; microcrystalline wax; Fischer-Tropsch wax; synthetic hydrocarbon waxes synthesized by Synthol method, Hydrocaol method, or Arge method; synthetic waxes including a compound having one carbon atom as a monomer unit; hydrocarbon waxes having a functional group such as hydroxyl group and carboxyl group; mixtures of a hydrocarbon wax and a hydrocarbon wax having a functional group; and these waxes to which a vinyl monomer such as styrene, a maleate, an acrylate, a methacrylate, or a maleic anhydride is grafted.

The above release agents being further subjected to a press sweating method, a solvent method, a recrystallization method, a vacuum distillation method, a supercritical gas extraction method, or a solution crystallization method, so as to more narrow the molecular weight distribution thereof, are also usable. Further, the above release agents from which impurities such as low-molecular-weight solid fatty acids, low-molecular-weight solid alcohols, and low-molecular-weight solid compounds are removed are also usable.

In some embodiments, the release agent has a melting point of 60 to 140° C. or 70 to 120° C. in view of improvement of blocking resistance and offset resistance of the toner. When the melting point is less than 60° C., blocking resistance of the toner may be poor. When the melting point is greater than 140° C., hot offset resistance of the toner may be poor. The melting point of release agent is defined as a temperature at which the maximum endothermic peak is observed in an endothermic curve measured by DSC.

Endothermic curve can be measured using a high-precision inner-heat power-compensation differential scanning calorimeter based on a method according to ASTM D3418-82. In some embodiments, an endothermic curve is obtained by heating a sample at a heating rate of 10° C./min after preliminarily heating and cooling the sample.

In some embodiments, the content of the release agent in the toner is 1 to 30% by weight or 2 to 20% by weight.

In some embodiments, the toner includes a magnetic material. Specific examples of usable magnetic materials include, but are not limited to, magnetic iron oxides (e.g., magnetite, maghemite, ferrite) and iron oxides containing other metal oxides; metals (e.g., iron, cobalt, nickel) and their alloys with aluminum, cobalt, copper, lead, magnesium, tin, zinc, antimony, beryllium, bismuth, cadmium, calcium, manganese, selenium, titanium, tungsten, and vanadium; and mixtures of the above compounds.

Specific examples of usable magnetic materials further include, but are not limited to, $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. Two or more of these materials can be used in combination. In some embodiments, fine powders of $Fe_3O_4$ and $\gamma$-$Fe_2O_3$ are used. The magnetic material may be used as a colorant.

Additionally, magnetic iron oxides (e.g., magnetite, maghemite, ferrite) including a heterogeneous element and mixtures thereof are also usable. The heterogeneous element may be, for example, lithium, beryllium, boron, magnesium, aluminum, silicon, phosphorus, germanium, zirconium, tin, sulfur, calcium, scandium, titanium, vanadium, chrome, manganese, cobalt, nickel, copper, zinc, or gallium. In some embodiments, magnesium, aluminum, silicon, phosphorus, or zirconium is used. The heterogeneous element may be incorporated into crystal lattice of an iron oxide. Alternatively, an oxide of the heterogeneous element may be incorporated into an iron oxide. Alternatively, an oxide or hydroxide of the heterogeneous element may exist on the surface of an iron oxide. In some embodiments, an oxide of the heterogeneous element is incorporated into an iron oxide.

The heterogeneous element may be incorporated into an iron oxide by mixing a salt of the heterogeneous element with raw materials of the iron oxide while controlling pH. The heterogeneous element may be deposited on the surface of iron oxide particles by controlling pH or adding a salt of the heterogeneous element after the iron oxide particles are produced.

In some embodiments, the content of the magnetic material is 10 to 200 parts by weight or 20 to 150 parts by weight based on 100 parts of the binder resin. In some embodiments, the magnetic material has a number average particle diameter of 0.1 to 1 μm or 0.1 to 0.5 μm. The number average particle diameter may be determined by analyzing a transmission electron microscope image of the magnetic material with a digitizer.

In some embodiments, the magnetic material has an anti-magnetic force of 20 to 150 oersted, a saturated magnetization of 50 to 200 emu/g, and a remanent magnetization of 2 to 20 emu/g in a magnetic field of 10K oersted.

In some embodiments, the toner includes a fluidity improving agent.

Specific materials usable as the fluidity improving agent include, but are not limited to, fine powders of fluorocarbon resins such as vinylidene fluoride and polytetrafluoroethylene; fine powders of silica prepared by a wet process or a dry process; fine powders of titanium oxide; fine powders of alumina; and fine powders of silica, titanium oxide, and alumina which are surface-treated with a silane-coupling agent, a titanium-coupling agent, or a silicone oil. In some embodiments, fine powders of silica, titanium oxide, or alumina are used. In some embodiments, fine powders of silica which are surface-treated with a silane-coupling agent or a silicone oil are used. Fine powders of silica may be obtained by gas phase oxidation of silicon halide, and they are generally called as fumed silica.

Specific examples of commercially available fine powders of such silica obtained by gas phase oxidation of silicon halides include, but are not limited to, AEROSIL-130, -300, -380, -TT600, -MOX170, -MOX80, and -COK84 (from Nippon Aerosil Co., Ltd.); CAB-O-SIL-M-5, -MS-7, -MS-75, -HS-5, and -EH-5 (from Cabot Corporation); WACKER HDK-N20V15, -N20E, -T30, and -T40 (from Wacker Chemie AG); D-C Fine Silica (from Dow Corning Corporation); and Fransol (from Fransil).

In some embodiments, fine powders of hydrophobized silica obtained by gas phase oxidation of silicon halides having a hydrophobicity degree of 30 to 80% measured by a methanol titration test are used. Hydrophobicity is given by chemically or physically treating silica with an organic silicon compound which is reactive with or adsorptive to the silica. In some embodiments, fine powders of silica obtained by gas phase oxidation of silicon halides treated with an organic silicon compound are used.

Specific examples of the organic silicon compound for treating silica include, but are not limited to, hydroxypropyltrimethoxysilane, phenyltrimethoxysilane, n-hexadecyltrimethoxysilane, n-octadecyltrimethoxysilane, vinyltrimethoxysilane, vinyltriethoxysilane, vinyltriacetoxysilane, dimethylvinylchlorosilane, divinylchlorosilane, γ-methacryloxypropyltrimethoxysilane, hexamethyldisilazane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units and 0 to 1 terminal silanol group. Other than the above compounds, silicone oils such as dimethyl silicone oil are also usable. Two or more of these materials can be used in combination.

In some embodiments, the fluidity improving agent has an average primary particle diameter of 0.001 to 2 μm or 0.002 to 0.2 μm. In some embodiments, the fluidity improving agent has a number average particle diameter of 5 to 100 nm or 5 to 50 nm.

In some embodiments, the fluidity improving agent has a specific surface area of 30 $m^2/g$ or more or 60 to 400 $m^2/g$ measured by the BET method employing nitrogen adsorption. In some embodiments, the surface-treated fluidity improving agent has a specific surface area of 20 $m^2/g$ or more or 40 to 300 $m^2/g$ measured by the BET method employing nitrogen adsorption.

In some embodiments, the content of the fluidity improving agent in the toner is 0.03 to 8 parts by weight based on 100 parts by weight of the toner.

A cleanability improving agent is adapted to improve removability of toner from an electrostatic latent image bearing member or a primary transfer medium. Specific materials used as the cleanability improving agent include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, fine particles of polymers having a relatively narrow size distribution and a volume average particle diameter of 0.01 to 1 μm are used.

The fluidity improving agent and cleanability improving agent are adhered to or fixed on the surface of the toner. Therefore, they may be collectively called as external additives. The external additives may be added to the toner by a powder mixer. Specific examples of usable mixers include, but are not limited to, a V-type mixer, a Rocking mixer, a Loedige mixer, a Nauta mixer, and a Henschel mixer. Additionally, HYBRIDIZER, MECHANOFUSION, and Q-MIXER are also usable.

Generally, as the particle size of toner decreases, dot and thin line reproducibility of the toner improves. On the other hand, as the particle size of toner decreases, developability and transferability of the toner deteriorate. In some embodiments, the toner has a weight average particle diameter of 1 to 15 μm, 2 to 10 μm, or 3 to 3 μm.

Particle size distribution is determined from the ratio (D4/Dn) of the weight average particle diameter (D4) to the number average particle diameter (Dn). A toner having a ratio D4/Dn of 1 is monodisperse. Related-art pulverization toners may have a D4/Dn of 1.2 to 1.4 in view of productivity and cost. Because the particle size distribution of toner particles remaining in a developing device is varied as image development is repeated, the initial particle size distribution may be set as narrow as possible. In some embodiments, D4/Dn is 1.00 to 1.15 or 1.00 to 1.10.

The toner constituents liquid may be prepared by dissolving or dispersing toner constituents, such as the binder resin, colorant, and charge controlling agent, in an organic solvent.

Specific examples of usable organic solvents include, but are not limited to, ethers, ketones, esters, hydrocarbons, and alcohols. In some embodiments, tetrahydrofuran (THF), acetone, methyl ethyl ketone (MEK), ethyl acetate, or toluene is used. Two or more of these solvents can be used in combination.

The toner constituents liquid may be subjected to a dispersion treatment using a homomixer or bead mill so that dispersoids are finely dispersed. In some embodiments, the toner constituents liquid has a solid content of 5 to 40% by weight. When the solid content is less than 5% by weight, productivity may be poor. Also, dispersoids such as colorant, release agent, and magnetic material may settle out or aggregate, resulting in production of inhomogeneous toner particles. When the solid content is greater than 40% by weight, small-sized toner may not be obtained.

The toner may be mixed with a carrier to be used as a two-component developer. The carrier may comprise, for example, a ferrite, a magnetite, or a resin-coated carrier.

The resin-coated carrier is comprised of core particles covered with a resin coating layer.

Specific materials usable as the core particles include, but are not limited to, oxides (e.g., ferrite, iron-excess ferrite, magnetite, γ-iron oxide), metals (e.g., iron, cobalt, nickel) and alloys thereof. The core particles may include an element such as iron, cobalt, nickel, aluminum, copper, lead, magnesium, tin, zinc, antimony, beryllium, bismuth, calcium, manganese, selenium, titanium, tungsten, and vanadium. In some embodiments, copper-zinc-iron ferrite or manganese-magnesium-iron ferrite is used.

Specific examples of usable resins for the resin coating layer include, but are not limited to, styrene-acrylic resins (e.g., styrene-acrylate copolymer, styrene-methacrylate copolymer), acrylic resins (e.g., acrylate copolymer, methacrylate copolymer), fluorine-containing resins (e.g., polytetrafluoroethylene, monochlorotrifluoroethylene polymer, polyvinylidene fluoride), silicone resins, polyester resins, polyamide resins, polyvinyl butyral resins, and aminoacrylate resins. Further, ionomer resins and polyphenylene sulfide resins are also usable. Two or more of these resins can be used in combination. In some embodiments, styrene-methyl methacrylate copolymer, a mixture of a fluorine-containing resin and a styrene copolymer, or a silicone resin is used.

The mixture of a fluorine-containing resin and a styrene copolymer may be, for example, a mixture of polyvinylidene fluoride and styrene-methyl methacrylate copolymer; a mixture of polytetrafluoroethylene and styrene-methyl methacrylate copolymer; or a mixture of a vinylidene fluoride-tetrafluoroethylene copolymer (copolymerization ratio is 10:90 to 90:10), a styrene-2-ethylhexyl acrylate copolymer (copolymerization ratio is 10:90 to 90:10), and a styrene-2-ethylhexyl acrylate-methyl methacrylate copolymer (copolymerization ratio is (20 to 60):(5 to 30):(10 to 50)).

The silicone resin may be, for example, a nitrogen-containing silicon resin or a modified silicone resin obtained by reacting a nitrogen-containing silane-coupling agent with a silicone resin.

Alternatively, the carrier may be also comprised of resin particles in which magnetic powder is dispersed.

The resin-coated carrier may be obtained by applying a solvent solution or suspension of a resin (i.e., a coating liquid) to core particles or mixing a resin and core particles in a dry condition.

In some embodiments, the content of the coating resin in the carrier is 0.01 to 5% by weight or 0.1 to 1% by weight.

In some embodiments, core particles are covered with a mixture of two or more materials. For example, 100 parts by weight of titanium oxide particles covered with 12 parts by weight of a mixture of dimethyldichlorosilane and dimethyl silicone oil (mixing ratio=1:5) can be used. As another example, 100 parts by weight of silica particles covered with 20 parts by weight of a mixture of dimethyldichlorosilane and dimethyl silicone oil (mixing ratio=1:5) can be used.

In some embodiments, the carrier has a resistivity of $10^6$ to $10^{10}$ Ω·cm. Resistivity of the carrier depends on roughness of its surface or content of the coating resin.

In some embodiments, the carrier has a particle diameter of 4 to 200 μm, 10 to 150 μm, or 20 to 100 μm. In some embodiments, the resin-coated carrier having a 50% particle diameter of 20 to 70 μm is used.

In some embodiments, the two-component developer includes the toner in an amount of 1 to 100 parts or 2 to 50 parts by weight based on 100 parts by weight of the carrier.

The toner may be also used as a magnetic or non-magnetic one-component developer including no carrier.

In accordance with some embodiments, the toner can be used for an image forming method including an electrostatic latent image forming process in which an electrostatic latent image is formed on an electrostatic latent image bearing member; a developing process in which the electrostatic latent image is developed into a toner image that is visible with the toner; a transfer process in which the toner image is transferred from the electrostatic latent image bearing member onto a recording medium; and a fixing process in which the toner image is fixed on the recording medium. The image forming method may optionally include other processes such as a neutralization process, a cleaning process, and a recycle process.

In accordance with some embodiments, the toner can be used for an image forming apparatus including an electrostatic latent image bearing member; an electrostatic latent image forming device for forming an electrostatic latent image on the electrostatic latent image bearing member; a developing device for developing the electrostatic latent image into a toner image that is visible with the toner; a transfer device for transferring the toner image from the electrostatic latent image bearing member onto a recording medium; and a fixing device for fixing the toner image on the recording medium. The image forming apparatus may optionally include other devices such as a neutralization device, a cleaning device, and a recycle device.

The electrostatic latent image forming process is a process which forms an electrostatic latent image on an electrostatic latent image bearing member. There is not a limit on material, shape, structure, or size on the electrostatic latent image bearing member. In some embodiments, the electrostatic latent image bearing member has a drum-like shape and is comprised of an organic photoconductor or an inorganic photoconductor, such as amorphous silicone and selenium.

The electrostatic latent image is formed by uniformly charging a surface of the electrostatic latent image bearing member and irradiating the charged surface with light containing image information. The electrostatic latent image forming device may comprise, for example, a charger for uniformly charging a surface of the electrostatic latent image bearing member by supplying a voltage thereto and an irradiator for irradiating the charged surface with light containing image information.

The charger may be, for example, a contact charger equipped with a conductive or semiconductive roll, brush, film, or rubber blade, or a non-contact charger such as corotron and scorotron that use corona discharge.

The irradiator may be, for example, a radiation optical type, a rod lens array type, a laser optical type, or a liquid crystal shutter optical type. The electrostatic latent image bearing member may be irradiated with light from the reverse surface (back surface) side thereof.

The developing process is a process which develops the electrostatic latent image into a toner image with a developer including the toner. The developing device is adapted to contain the developer and to supply the toner to the electrostatic latent image with or without contacting the electrostatic latent image.

The developing device may employ either a dry developing method or a wet developing method. The developing device may employ either a monochromatic developing method or a multicolor developing method. In some embodiments, the developing device includes an agitator for frictionally charging the developer and a rotatable magnet roller. In these embodiments, toner particles and carrier particles are mixed and agitated so that the toner particles are frictionally charged. The charged toner particles and carrier particles are borne on the surface of the magnet roller forming chainlike aggregations (hereinafter "magnetic brush"). The magnet roller is disposed adjacent to the electrostatic latent image bearing member. Therefore, a part of the toner particles in the magnetic brush migrates from the surface of the magnet roller to the surface of the electrostatic latent image bearing member due to electrical attractive force. As a result, the electrostatic latent image formed on the electrostatic latent image bearing member is developed into a toner image. The developer contained in the developing device may be either a one-component developer or a two-component developer.

The transfer process is a process that transfers the toner image from the electrostatic latent image bearing member onto a recording medium. In some embodiments, the transfer process includes a primary transfer process which transfers a toner image onto an intermediate transfer medium and a secondary transfer process which further transfers the toner image onto a recording medium. In some embodiments, a plurality of toner images with different colors is primarily transferred onto an intermediate transfer medium to form a composite toner image and the composite toner image is secondarily transferred onto a recording medium.

In some embodiments, the transfer device includes a plurality of primary transfer devices for transferring each toner image onto the intermediate transfer medium to form a composite toner image and a secondary transfer device for transferring the composite toner image onto the recording medium. The intermediate transfer medium may comprise a seamless belt. In some embodiments, the transfer device contains a transfer unit for separating a toner image from the electrostatic latent image bearing member toward a recording medium side. The transfer device may include either a single transfer unit or a plurality of transfer units.

The transfer unit may be, for example, a corona discharger, a transfer belt, a transfer roller, a pressure transfer roller, or an adhesive transfer unit.

The recording medium is not limited to a specific material, and any kind of material can be used as the recording medium.

The fixing process is a process which fixes the toner image on a recording medium. Each single-color toner image may be independently fixed on a recording medium. Alternatively, a multi-color composite toner image, in which multiple single-color toner images are superimposed on one another, may be fixed on a recording medium at once. The fixing device may include a heating member and a pressing member.

For example, the fixing device may include a combination of a heating roller and a pressing roller, or a combination of a heating roller, a pressing roller, and an endless belt. The heating temperature may be 120 to 200° C.

In the fixing process, an optical fixer can be used in place of or in combination with the fixing device.

The neutralization process is a process which neutralizes the electrostatic latent image bearing member by applying a neutralization bias thereto. The neutralization device may be, for example, a neutralization lamp.

The cleaning process is a process which removes residual toner particles remaining on the electrostatic latent image bearing member. The cleaning device may be, for example, a magnetic brush cleaner, an electrostatic brush cleaner, a magnetic roller cleaner, a blade cleaner, a brush cleaner, or a web cleaner.

The recycle process is a process which supplies the residual toner particles collected in the cleaning process to the developing device. The recycle device may be, for example, a conveyer.

Figure 16:
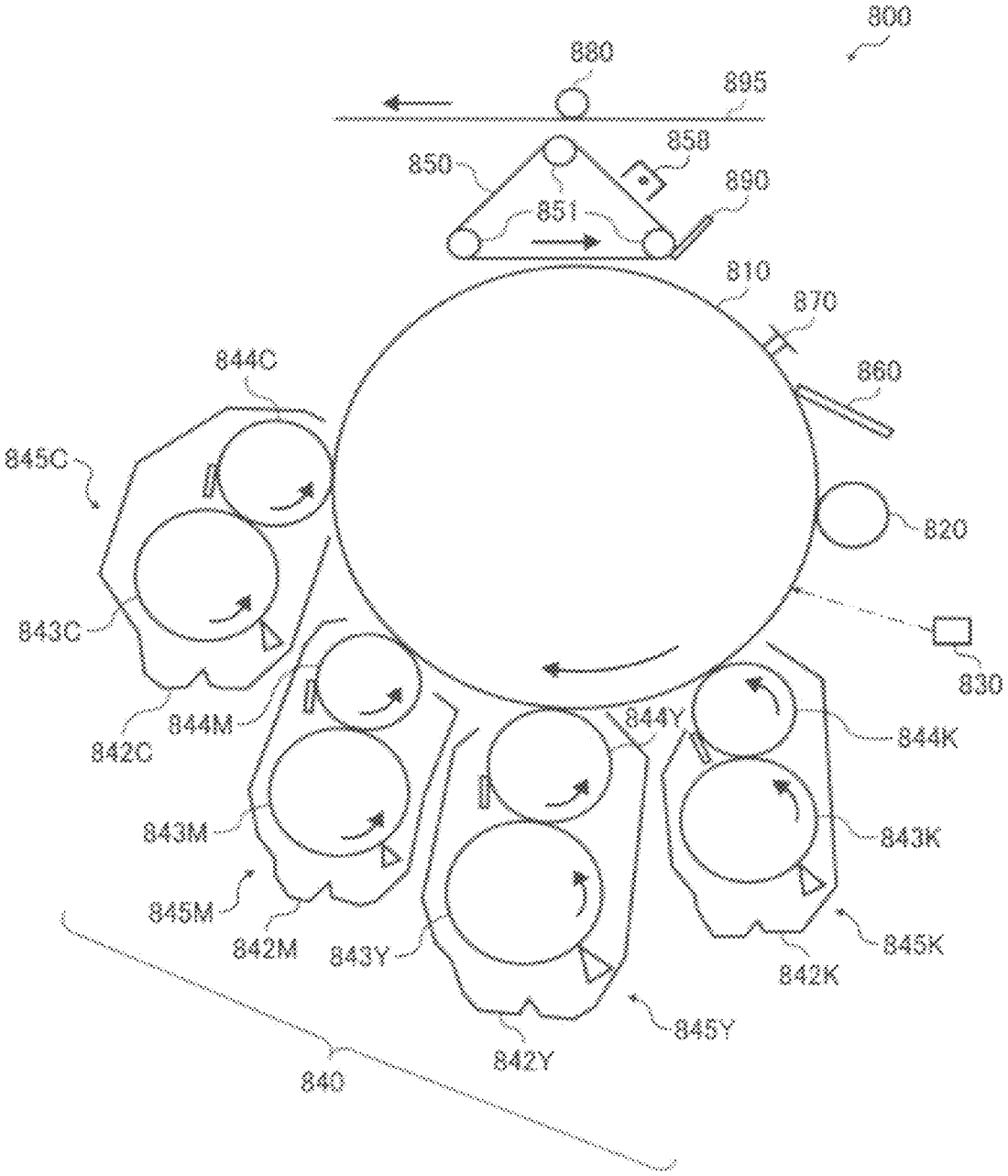
FIG. 16 is a schematic view of an image forming apparatus according to an embodiment.

FIG. 16 is a schematic view of an image forming apparatus according to an embodiment. An image forming apparatus 800 includes a photoreceptor drum 810, a charging roller 820, an irradiator 830, a developing device 840, an intermediate transfer medium 850, a cleaning device 860, and a neutralization lamp 870.

The intermediate transfer medium 850 is a seamless belt stretched taut with three rollers 851 and is movable in a direction indicated by arrow in FIG. 16. One of the three rollers 851 is adapted to supply a primary transfer bias to the intermediate transfer medium 850. An intermediate transfer medium cleaning blade 890 and a transfer roller 880 are disposed adjacent to the intermediate transfer medium 850. The transfer roller 880 is adapted to supply a secondary transfer bias for transferring a toner image onto a recording medium 895. Around the intermediate transfer medium 850, a corona charger 858 adapted to charge the intermediate transfer medium 850 is disposed. The corona charger 858 is disposed between the contact points of the intermediate transfer medium 850 with the photoreceptor drum 810 and the recording medium 895.

The developing device 840 includes a black developing unit 845K, an yellow developing unit 845Y, a magenta developing unit 845M, and a cyan developing unit 845C. The black developing unit 845K includes a developer container 842K, a developer supply roller 843K, and a developing roller 844K. The yellow developing unit 845Y includes a developer container 842Y, a developer supply roller 843Y, and a developing roller 844Y. The magenta developing unit 845M includes a developer container 842M, a developer supply roller 843M, and a developing roller 844M. The cyan developing unit 845C includes a developer container 842C, a developer supply roller 843C, and a developing roller 844C.

In the image forming apparatus 800, the charging roller 820 uniformly charges the photoreceptor drum 810. The irradiator 830 irradiates the photoreceptor drum 810 with light containing image information to form an electrostatic latent image thereon. The developing device 840 supplies toner to the electrostatic latent image to form a toner image. The toner image is primarily transferred onto the intermediate transfer medium 850 by a voltage supplied from the roller 851 and is secondarily transferred onto the recording medium 895. Residual toner particles remaining on the photoreceptor drum 810 are removed by the cleaning device 860. Residual charge remaining on the photoreceptor drum 810 is neutralized by the neutralization lamp 870.

Figure 17:
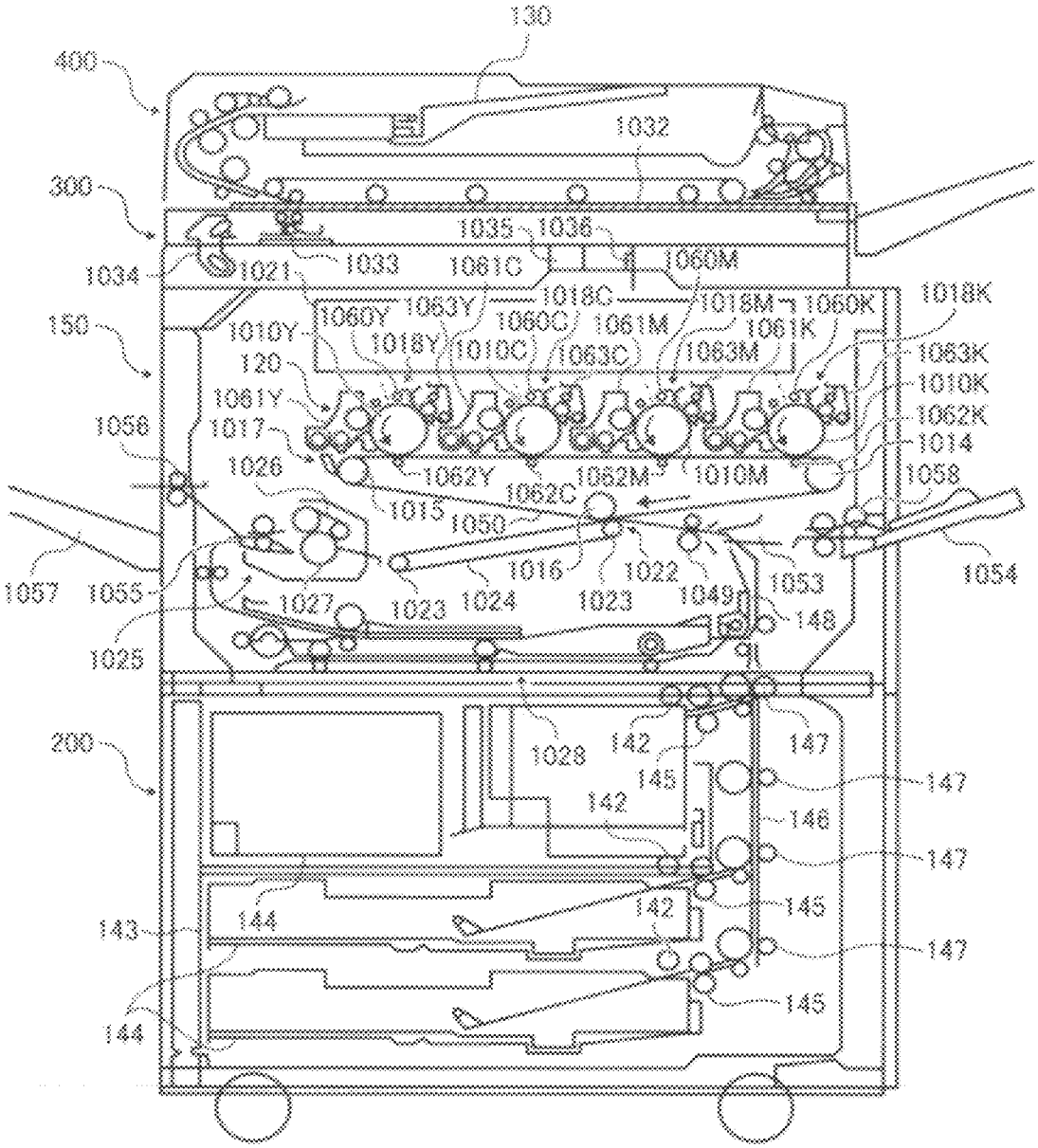
FIG. 17 is a schematic view of an image forming apparatus according to another embodiment.

FIG. 17 is a schematic view of an image forming apparatus according to another embodiment. The image forming apparatus illustrated in FIG. 17 is a tandem-type image forming apparatus including a main body 150, a paper feed table 200, a scanner 300, and an automatic document feeder (ADF) 400.

A seamless-belt intermediate transfer medium 1050 is disposed at the center of the main body 150. The intermediate transfer medium 1050 is stretched taut with support rollers 1014, 1015, and 1016 and is rotatable clockwise. A cleaner 1017 is disposed adjacent to the support roller 1015. The cleaner 1017 is adapted to remove residual toner particles remaining on the intermediate transfer medium 1050. Four image forming units 1018Y, 1018C, 1018M, and 1018K (hereinafter collectively the "image forming units 1018") adapted to form respective toner images of yellow, cyan, magenta, and cyan are disposed in tandem facing a surface of the intermediate transfer medium 1050. The image forming units 1018 forms a tandem developing device 120. An irradiator 1021 is disposed adjacent to the tandem developing device 120. A secondary transfer device 1022 is disposed on the opposite side of the tandem developing device 120 with respect to the intermediate transfer medium 1050. The secondary transfer device 1022 includes a seamless secondary transfer belt 1024 stretched taut with a pair of rollers 1023. A recording medium conveyed by the secondary transfer belt 1024 is capable of contacting the intermediate transfer medium 1050. A fixing device 1025 is disposed adjacent to the secondary transfer device 1022. The fixing device 1025 includes a seamless fixing belt 1026 and a pressing roller 1027 pressed against the fixing belt 1026. A reversing device 1028 adapted to reverse recording medium in duplexing is disposed adjacent to the secondary transfer device 1022 and the fixing device 1025.

In the tandem developing device 120, a full-color image is produced in the manner described below. A document is set on a document table 130 of the automatic document feeder 400. Alternatively, a document is set on a contact glass 1032 of the scanner 300 while lifting up the automatic document feeder 400, followed by holding down of the automatic document feeder 400. Upon pressing of a switch, in a case in which a document is set on the contact glass 1032, the scanner 300 immediately starts driving so that a first runner 1033 and a second runner 1034 start moving. In a case in which a document is set on the automatic document feeder 400, the scanner 300 starts driving after the document is fed onto the contact glass 1032. The first runner 1033 directs light from a light source to the document, and reflects a light reflected from the document toward the second runner 1034. A mirror in the second runner 1034 reflects the light toward a reading sensor 1036 through an imaging lens 1035. The light is then received by the reading sensor 1036. Thus, the document is read and image information of yellow, cyan, magenta, and black are obtained.

The image information of yellow, cyan, magenta, and black are respectively transmitted to the image forming units 1018Y, 1018C, 1018M, and 1018K. The image forming units 1018Y, 1018C, 1018M, and 1018K form respective toner images of yellow, cyan, magenta, and black. The image forming units 1018Y, 1018C, 1018M, and 1018K include electrostatic latent image bearing members 1010Y, 1010C, 1010M, and 1010K, respectively. Each of the image forming units 1018 includes a charger 1060 adapted to uniformly charge the electrostatic latent image bearing member 1011. Each of the image forming units 1018 further includes a developing device 1061 adapted to develop an electrostatic latent image formed on the electrostatic latent image bearing member 1010 with a toner to form a toner image. Each of the image forming units 1018 further includes a transfer charger 1062 adapted to transfer the toner image on the intermediate transfer medium 1050, a cleaner 63, and a neutralizer 1064. Thus, images of yellow, cyan, magenta, and black are formed based on the image information.

The toner images of yellow, cyan, magenta, and black are sequentially transferred from the respective electrostatic latent image bearing members 1010Y, 1010C, 1010M, and 1010K onto the intermediate transfer medium 1050 that is endlessly moving so that the toner images are superimposed on one another. Thus, a composite full-color toner image is formed on the intermediate transfer medium 1050.

On the other hand, upon pressing of the switch, one of paper feed rollers 142 starts rotating in the paper feed table 200 so that, a sheet of a recording medium is fed from one of paper feed cassettes 144 in a paper bank 143. The sheet is separated by one of separation rollers 145 and fed to a paper feed path 146. Feed rollers 147 feed the sheet to a paper feed path 148. The sheet is stopped by a registration roller 1049. Alternatively, a recording medium may be fed from a manual feed tray 1054. A separation roller 1058 separates a sheet of the recording medium and feeds it to a manual paper feed path 1053. The sheet is stopped by the registration roller 1049. Although the registration roller 1049 is generally grounded, the registration roller 1049 can be supplied with a bias for the purpose of removing paper powders from the sheet. The registration roller 1049 feeds the sheet to the gap between the intermediate transfer medium 1050 and the secondary transfer device 1022 in synchronization with an entry of the composite toner image on the intermediate transfer medium 1050 into the gap. The secondary transfer device 1022 transfers the composite toner image on the sheet of the recording medium. After the composite toner image is transferred, residual toner particles remaining on the intermediate transfer medium 1050 are removed by the cleaner 1017.

The sheet having the composite toner image thereon is fed from the secondary transfer device 1022 to the fixing device 1025. The fixing device 1025 fixes the composite toner image on the sheet by application of heat and/or pressure. A switch claw 1055 switches paper feed paths so that the sheet is discharged onto a discharge tray 1057 by rotation of a discharge roller 1056. Alternatively, the switch claw 1055 switches paper feed paths so that the sheet gets reversed in the sheet reversing device 1028. After forming another toner image on the back side of the sheet, the sheet is discharged onto the discharge tray 1057 by rotation of the discharge roller 1056.

Figure 18:
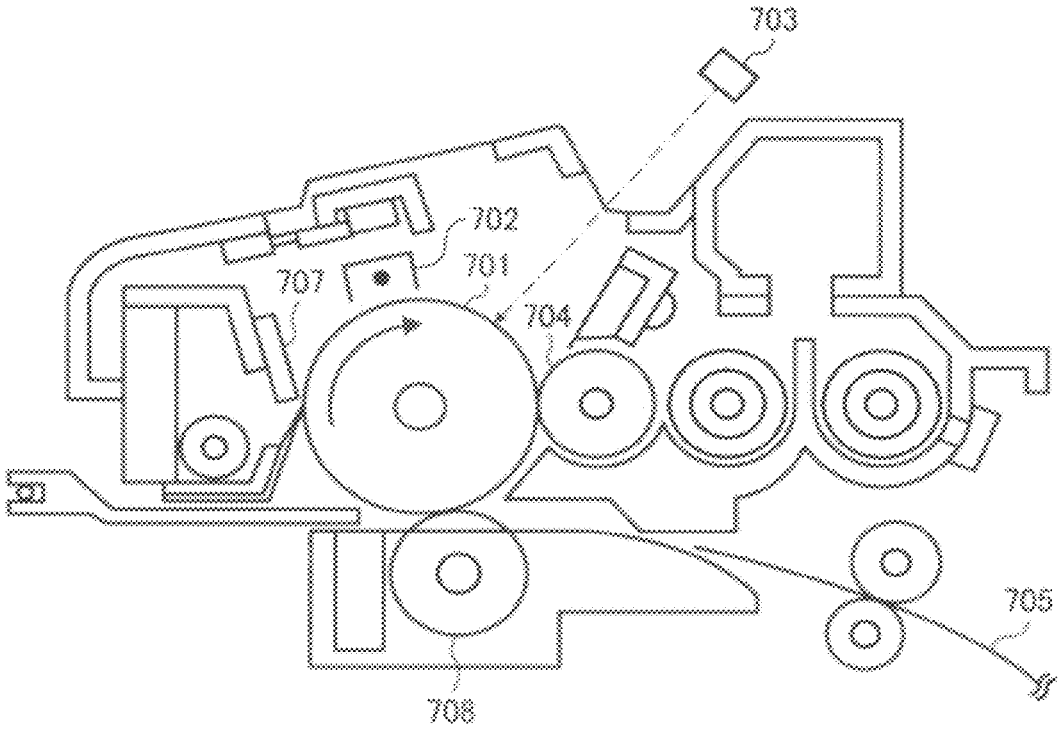
FIG. 18 is a schematic view of a process cartridge according to an embodiment.

FIG. 18 is a schematic view of a process cartridge according to an embodiment. The process cartridge includes a photoreceptor 701, a charger 702, a developing device 704, a transfer device 708, and a cleaner 707. The process cartridge is detachably attachable to the above-described image forming apparatus. The photoreceptor 701 is charged by the charger 702 and exposed to a light beam 703 emitted from an irradiator while rotating in a direction indicated by arrow in FIG. 18. As a result, an electrostatic latent image is formed on the photoreceptor 701. The electrostatic latent image is developed into a toner image by the developing device 704. The toner image is transferred onto a recording medium 705 by the transfer device 708 and printed out. After the toner image is transferred, the surface of the photoreceptor 701 is cleaned by the cleaner 707 and is neutralized by a neutralizer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester Resin

The air in a 5-liter four-necked flask equipped with a nitrogen inlet pipe, a dewatering pipe, a stirrer, and a thermocouple is substituted with nitrogen atmosphere. In the flask, 0.5 mol of propylene oxide adduct of bisphenol A, 0.5 mol of propylene oxide adduct of bisphenol A, and 0.9 mol of terephthalic acid are subjected to a polycondensation reaction for 4 hours at 180° C. in the presence of tin octylate as an esterification catalyst. Further, 0.07 mol of trimellitic acid are added to the flask and the mixture is subjected to a reaction for 1 hour at 210° C. and subsequent 1 hour at 8 KPa. Thus, a polyester resin A is prepared.

The polyester resin A has a weight average molecular weight (Mw) of 93,000, a number average molecular weight (Mn) of 3,500, and a peak molecular weight (Mp) of 48,000. The content of THF-insoluble components in the polyester resin A is 0%. Weight average molecular weight (Mw), number average molecular weight (Mn), peak molecular weight (Mp), and THF-insoluble component content are measured as follows.

Measurement of Weight Average Molecular Weight (Mw)

A molecular weight distribution of the polyester resin A is measured by a gel permeation chromatography instrument GPC-150C (from Waters) equipped with columns SHOWDEX® KF801 to 807 (from Showa Denko K.K.). The columns are set in a heat chamber at 40° C. and THF (tetrahydrofuran) is flowed in the columns at a flow rate of 1 ml/min. The polyester resin A in an amount of 0.05 g is dissolved in 5 g of THF and the THF solution is filtered with a pretreatment filter (for example, a CROMATODISC having a pore size of 0.45 μm from Kurabo Industries Ltd.). The THF solution in a volume of 50 to 200 μl is injected so that the sample concentration becomes 0.05 to 0.6% by weight. The number average molecular weight (Mn), weight average molecular weight (Mw), and peak molecular weight (Mp) are determined from the measured molecular weight distribution with reference to a calibration curve compiled from several kinds of monodisperse polystyrene standard samples. The calibration curve may be complied from, for example, polystyrene standard samples having a molecular weight of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$, available from Pressure Chemical Company or Tosoh Corporation. A refractive index detector is used as the detector.

Measurement of THF-Insoluble Components

A mixture of 10 g of the polyester resin A and 90 g of THF is agitated for 60 minutes at 20° C. and left for 20 to 30 hours. The components settled out are separated by suction filtration using a FILTER PAPER No. 7 (from ADVANTEC) while being washed with THF. The separated components are heated for 3 hours at 120° C. so as to volatilize THF. Thus, THF-insoluble components are obtained and weighed.

Preparation of Polyester Resin Solution

The polyester resin A in an amount of 1 part and ethyl acetate in an amount of 9 parts are mixed so that the polyester resin A is completely dissolved in the ethyl acetate. Thus, a polyester resin A solution is prepared.

Preparation of Charge Controlling Agent Solutions and Dispersions

FCA-2508N (i.e., a polycondensation product of a phenol and an aldehyde from Fujikura Kasei Co., Ltd.) in an amount of 1 part and ethyl acetate in an amount of 4 parts are mixed. Thus, an FCA-2508N solution A is prepared.

BONTRON E-84 (from Orient Chemical Industries Co., Ltd.) in an amount of 1 part and ethyl acetate in an amount of 4 parts are mixed and subjected to a bead mill treatment. Thus, a BONTRON E-84 dispersion A is prepared.

BONTRON S-34 (from Orient Chemical Industries Co., Ltd.) in an amount of 1 part and ethyl acetate in an amount of 4 parts are mixed so that the BONTRON S-34 is dissolved in the ethyl acetate. Thus, a BONTRON S-34 solution A is prepared.

Preparation of Colorant Dispersion

A carbon black (REGAL 400 from Cabot Corporation) in an amount of 20 parts and a colorant dispersant (AJISPER PB821 from Ajinomoto Fine-Techno Co., Inc.) in an amount of 2 parts are primarily dispersed in ethyl acetate in an amount of 78 parts with a mixer having agitation blades. The resulting primary dispersion is further subjected to a dispersion treatment using a DYNOMILL so that the colorant is further pulverized by strong shearing force. The resulting secondary dispersion is filtered with a PTFE filter having pores of 1 μm. Thus, a colorant dispersion A is prepared.

Preparation of Wax Dispersion

A carnauba wax in an amount of 1 part and ethyl acetate in an amount of 4 parts are heated to 85° C. and agitated for 20 minutes so that the carnauba wax is dissolved in the ethyl acetate. The resulting solution is rapidly cooled so that fine particles of the carnauba wax are deposited. The resulting primary dispersion is further subjected to a dispersion treatment using a bead mill LMZ06 (from Ashizawa Finetech Ltd.) filled with zirconia beads having a diameter of 0.1 μm so that the fine particles of the wax are further pulverized by shearing force until the fine particles have an average particle diameter of 0.3 μm and a maximum particle diameter of 0.8 μm or less. Thus, a wax dispersion A is prepared.

Toner composition ratios in the following Examples and Comparative Examples are shown in Table 1.

Example 1

The polyester resin A solution in an amount of 1,000 parts, the FCA-2508N solution A in an amount of 10 parts, the wax dispersion A in an amount of 50 parts, the colorant dispersion A in an amount of 25 parts, and ethyl acetate in an amount of 90 parts are mixed. The mixture is filtered with a filter having openings of 1 μm to prepare a toner constituents liquid.

The toner constituents liquid is subjected to the method of manufacturing toner according to an embodiment under the following conditions.

Liquid Column Resonance Conditions

Resonant mode: N=2

Length between longitudinal ends of liquid column resonance liquid chamber: L=1.8 mm Height of an end frame of liquid column resonance liquid chamber closer to liquid common supply path: h1=80 μm Height of communication opening in liquid column resonance liquid chamber: h2=40 μm Toner Particle Preparation Conditions A Specific weight of dispersion: $\rho$=1.1 g/cm$^3$ Nozzle shape: True circle Nozzle diameter: 8.0 μm Number of nozzles: 100 (1 per liquid column resonance liquid chamber×100 ch)

Dry air temperature: 40° C.

Applied voltage: 12.0 V

Drive frequency: 280 kHz

The resulting mother particles in an amount of 100 parts are mixed with 1.0 part of a hydrophobized silica (H2000 from Clariant Japan K.K.) and 1.0 part of a titanium oxide (JMT-150IB from TAYCA CORPORATION) using a HENSCHEL MIXER (from Mitsui Mining Co., Ltd.), and sieved with a mesh having openings of 30 μm. Thus, a toner 1 is prepared.

TABLE 1

(parts by weight)

| | Examples | | | | Comparative Examples | |
|---|---|---|---|---|---|---|
| | 1 | 2 | 3 | 4 | 1 | 2 |
| Polyester Resin A Solution | 1000 | 1000 | 1000 | 1000 | 1000 | 1000 |
| (-Polyester Resin A) | (100) | (100) | (100) | (100) | (100) | (100) |
| (-Ethyl Acetate) | (900) | (900) | (900) | (900) | (900) | (900) |
| FCA-2508N Solution A | 10 | 10 | 1 | 50 | | |
| (-FCA-2508N) | (2) | (2) | (0.2) | (10) | | |
| (-Ethyl Acetate) | (8) | (8) | (0.8) | (40) | | |
| BONTRON E-84 Dispersion A | | | | | 10 | |
| (-BONTRON E-84) | | | | | (2) | |
| (-Ethyl Acetate) | | | | | (8) | |
| BONTRON S-34 Solution A | | | | | | 10 |
| (-BONTRON S-34) | | | | | | (2) |
| (-Ethyl Acetate) | | | | | | (8) |
| Wax Dispersion A | 50 | 50 | 50 | 50 | 50 | 50 |
| (-Carnauba Wax) | (10) | (10) | (10) | (10) | (10) | (10) |
| (-Ethyl Acetate) | (40) | (40) | (40) | (40) | (40) | (40) |
| Colorant Dispersion A | 25 | 25 | 25 | 25 | 25 | 25 |
| (-Carbon Black) | (5) | (5) | (5) | (5) | (5) | (5) |
| (-Colorant Dispersant) | (0.5) | (0.5) | (0.5) | (0.5) | (0.5) | (0.5) |
| (-Ethyl Acetate) | (19.5) | (19.5) | (19.5) | (19.5) | (19.5) | (19.5) |
| Ethyl Acetate | 90 | 90 | 81 | 130 | 90 | 90 |
| Charge Controlling Agent Content (based on Toner) | 1.7% | 1.7% | 0.2% | 8.0% | 1.7% | 1.7% |
| Number of Nozzles per Liquid Column Resonance Liquid Chamber | 1 | 4 | 4 | 4 | 4 | 4 |

Example 2

The procedure in Example 1 is repeated except for replacing Toner Particle Preparation Conditions A with the following Toner Particle Preparation Conditions B. Thus, a toner 2 is prepared.

Toner Particle Preparation Conditions B

Specific weight of dispersion: $\rho=1.1$ g/cm$^3$

Nozzle shape: True circle

Nozzle diameter: 8.0 μm

Number of nozzles: 400 (4 per liquid column resonance liquid chamber×100 ch)

Minimum nozzle interval: 130 μm (All nozzles disposed at equal intervals)

Dry air temperature: 40° C.

Applied voltage: 12.0 V

Drive frequency: 340 kHz

Example 3

The procedure in Example 2 is repeated except that the used amounts of the FCA-2508N solution A and ethyl acetate are changed to 1 part and 81 parts, respectively. Thus, a toner 3 is prepared.

Example 4

The procedure in Example 2 is repeated except that the used amounts of the FCA-2508N solution A and ethyl acetate are changed to 50 parts and 130 parts, respectively. Thus, a toner 4 is prepared.

Comparative Example 1

The procedure in Example 2 is repeated except for replacing the FCA-2508N solution A with the BONTRON E-84 dispersion A. Thus, a comparative toner 1 is prepared.

Comparative Example 2

The procedure in Example 2 is repeated except for replacing the FCA-2508N solution a with the BONTRON S-34 dispersion A. Thus, a comparative toner 2 is prepared.

Evaluations

Measurement of Weight Average Particle Diameter (D4) and Number Average Particle Diameter (Dn)

Weight average particle diameter (D4) and volume average particle diameter (Dn) of toner are measured by a particle size analyzer MULTISIZER III (from Beckman Coulter, Inc.) having an aperture size of 100 μm and an analysis software program Beckman Coulter Multisizer 3 Version 3.51 as follows.

First, a 100-ml glass beaker is charged with 0.5 ml of a 10% surfactant (an alkylbenzene sulfonate NEOGEN SC-A from Dai-ichi Kogyo Seiyaku Co., Ltd.). A toner in an amount of 0.5 g is added to the beaker and mixed with a micro spatula. Further, 80 ml of ion-exchange water are added to the beaker. The resulting dispersion is subjected to a dispersion treatment for 10 minutes using an ultrasonic disperser (W-113 MK-II from Honda Electronics). The dispersion is subjected to a measurement by MULTISIZER III while adjusting the toner concentration to 8±2% by adding ISOTON III (from Beckman Coulter, Inc.). The following channels are employed during the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Accordingly, particles having a particle diameter of not less than 2.00 μm and less than 40.30 μm are subjected to the measurement.

Measurement of Average Circularity

The average circularity is measured with a flow type particle image analyzer FPIA-3000 (from Sysmex Corporation) as follows. First, 0.1 to 0.5 ml of a surfactant (e.g., an alkylbenzene sulfonate) are added to 100 to 150 ml of water from which solid impurities have been removed and 0.1 to 0.5 g of a toner are further added thereto. The resulting suspension is subjected to a dispersion treatment for about 1 to 3 minutes using an ultrasonic disperser. After adjusting the toner concentration in the suspension to 3,000 to 10,000 particles per micro-liter, the suspension is subjected to a measurement by FPIA-3000.

Measurement of Chargeability

In Normal-Temperature and Normal-Humidity Condition

A mixture of 100 parts of a silicone resin (organo straight silicone), 100 parts of toluene, 5 parts of γ-(2-aminoethyl) aminopropyl trimethoxysilane, and 10 parts of a carbon black is subjected to a dispersion treatment for 20 minutes using a HOMOMIXER to prepare a coating layer forming liquid. The coating layer forming liquid is applied to the surfaces of 1,000 parts of spherical magnetite particles having a particle diameter of 40 μm using a fluidized-bed coating device. Thus, a magnetic carrier is prepared.

The above-prepared toners and magnetic carrier are exposed to a 20° C./50% RH atmosphere for 24 hours. Thereafter, 5 parts of each toner and 95 parts of the magnetic carrier are mixed with a ball mill for 30 seconds, 10 minutes, or 30 minutes, to prepare two-component developers. The developers are subjected to a blow off method to measure charge quantity. When a developer prepared by mixing toner and carrier for 30 seconds has a similar charge quantity to that prepared by mixing toner and carrier for 10 minutes, the developer is generally regarded as being quickly chargeable. When a developer prepared by mixing toner and carrier for 30 minutes has a similar charge quantity to that prepared by mixing toner and carrier for 10 minutes, the developer is generally regarded as being stably chargeable.

In High-Temperature and High-Humidity Condition

The above-prepared toners and magnetic carrier are exposed to a 30° C./90% RH atmosphere for 24 hours. Thereafter, 5 parts of each toner and 95 parts of the magnetic carrier are mixed with a ball mill for 10 minutes to prepare two-component developers. The developers are subjected to a blow off method to measure charge quantity.

In Low-Temperature and Low-Humidity Condition

The above-prepared toners and magnetic carrier are exposed to a 10° C./15% RH atmosphere for 24 hours. Thereafter, 5 parts of each toner and 95 parts of the magnetic carrier are mixed with a ball mill for 10 minutes to prepare two-component developers. The developers are subjected to a blow off method to measure charge quantity.

When a developer has a small difference between charge quantity in high-temperature and high-humidity conditions and that in low-temperature and low-humidity conditions, the developer is generally regarded as having good environmental stability.

Blow Off Method

In the blow off method, 6 g of a developer is contained in a metallic cylindrical container, both bottom surface of which are equipped with a stainless-steel mesh having openings of 20 μm. Toner particles in the developer are blown off with nitrogen gas and residual carrier particles are subjected to a measurement of charge q. The weight of the blown-off toner particles is also measured. The charge quantity of the developer is determined from the equation q/m.

The evaluation results are shown in Table 2.

TABLE 2

| | | Examples | | | | Comparative Examples | |
|---|---|---|---|---|---|---|---|
| | | 1 | 2 | 1 | 2 | 1 | 2 |
| Weight Average Particle Diameter D4 (μm) | | 5.20 | 5.23 | 5.21 | 5.20 | 5.25 | 5.15 |
| Number Average Particle Diameter Dn (μm) | | 5.01 | 4.79 | 4.81 | 4.77 | 4.81 | 4.73 |
| D4/Dn | | 1.04 | 1.09 | 1.08 | 1.09 | 1.09 | 1.09 |
| Average Circularity | | 0.97 | 0.97 | 0.98 | 0.95 | 0.99 | 0.99 |
| Charge Quantity (−μC/g) | 30-sec agitation | 25.4 | 26.3 | 15.3 | 32.5 | 2.3 | 3.8 |
| | 10-min agitation | 26.0 | 27.0 | 20.5 | 33.4 | 10.7 | 10.0 |
| | 30-min agitation | 26.1 | 27.5 | 15.7 | 32.4 | 20.8 | 22.7 |
| | HH condition | 24.8 | 25.6 | 11.7 | 31.3 | 5.4 | 3.7 |
| | LL condition | 31.7 | 32.2 | 30.6 | 34.7 | 35.6 | 38.5 |

The developers of Examples 1 to 4 are quickly and stably chargeable regardless of environmental condition.

Evaluation of Image Stability

Each of the toners in an amount of 5 parts and the magnetic carrier in an amount of 95 parts are mixed with a TURBULA MIXER (from SHINMARU ENTERPRISES CORPORATION) to prepare a developer. Each developer is set in the black station of a copier IMAGIO MPC5000 (from Ricoh Co., Ltd.). Images having an image area ratio of 2%, 10%, or 50% are continuously printed on 100 sheets of a paper TYPE 6000 (from Ricoh Co., Ltd.) in 30° C./90% RH and 10° C./15% RH conditions.

When the 100th image is visually observed to have a similar quality to the initial image at every image area ratios and in every environmental conditions, image stability is graded "Good". When the 100th image is visually observed to have a poorer quality to the initial image at any image area ratio or in any condition, image stability is graded "Poor".

Evaluation of Cleanability

Each developer is set in the black station of a copier IMAGIO MPC5000 (from Ricoh Co., Ltd.). A toner image having an image area ratio of 30% is formed on a photoreceptor and transferred onto paper. Thereafter, the copier is stopped operating while the cleaning blade is removing residual toner particles remaining on the photoreceptor. The residual toner particles are transferred from the photoreceptor onto white paper with SCOTCH TAPE (from Sumitomo 3M Limited) and 10 randomly selected portions thereof are subjected to a measurement of image density by a Macbeth reflective densitometer RD514.

Cleanability of each toner is evaluated by a difference between the averaged image density and the image density of blank SCOTCH TAPE adhered to the white paper. The cleaning blade has been already spent in 20,000-printing. When the image density difference is not greater than 0.01, cleanability is graded "Very good". When the image density difference is greater than 0.01 and not greater than 0.015, cleanability is graded "Good". When the image density difference is greater than 0.015, cleanability is graded "Poor".

The evaluation results of image stability and cleanability are shown in Table 3.

TABLE 3

| | Examples | | | | Comparative Examples | |
|---|---|---|---|---|---|---|
| | 1 | 2 | 1 | 2 | 1 | 2 |
| Image Stability | Good | Good | Good | Good | Poor | Poor |
| Cleanability | Very good | Very good | Good | Very good | Poor | Poor |

In Examples 1 to 4, both image stability and cleanability are good either in the high-temperature and high-humidity condition and low-temperature and low-humidity condition. In Comparative Examples 1 and 2, the 100th image expressed slight gray color in white image portion, which indicates the occurrence of image fogging, in the high-temperature and high-humidity conditions. Additionally, although the 100th image has not been changed from the initial image, black color has been weakened.

Additional modifications and variations in accordance with further embodiments of the present invention are possible in light of the above teachings. It is therefore to be understood that within the scope of the appended claims the invention may be practiced other than as specifically described herein.

What is claimed is:

1. A method of manufacturing toner, comprising:

preparing a toner constituents liquid by dissolving or dispersing toner constituents in an organic solvent, the toner constituents including a binder resin and a charge controlling agent, the charge controlling agent including a polycondensation product of a phenol with an aldehyde;

forming a liquid column resonance standing wave in the toner constituents liquid in a chamber having at least one nozzle by vibrating the toner constituents liquid;

forming the toner constituents liquid into liquid droplets by discharging the toner constituents liquid from the nozzle, the nozzle being disposed within an area including antinodes of the liquid column resonance standing wave; and removing the organic solvent from the liquid droplets to solidify the liquid droplets.

2. The method according to claim 1, wherein the chamber has at least two nozzles.

3. The method according to claim 1, wherein the toner constituents include the charge controlling agent in an amount of 0.1 to 10% by weight.

4. The method according to claim 1, wherein the binder resin includes a polyester resin.

5. The method according to claim 1, wherein the forming the liquid column resonance standing wave includes vibrating the toner constituents liquid at a drive frequency f satisfying a relationship of $N \times c/(4\,L) \leq f \leq N \times c/(FLe)$, where L represents a length between both longitudinal ends of the liquid column resonance liquid chamber, Le represents a distance between a longitudinal end of the liquid column resonance liquid chamber closer to the liquid common supply path and the nozzle closest to the longitudinal end, c represents a sonic speed in the toner constituents liquid, and N represents an integer.

6. The method according to claim 1, wherein a relationship of $Le/L > 0.6$ is satisfied, where L represents a length between both longitudinal ends of the liquid column resonance liquid chamber and Le represents a distance between a longitudinal end of the liquid column resonance liquid chamber closer to the liquid common supply path and the nozzle closest to the longitudinal end.

7. The method according to claim 1, wherein the forming the liquid column resonance standing wave includes vibrating the toner constituents liquid at a drive frequency f satisfying a relationship of $N \times c/(4\,L) \leq f \leq (N+1) \times c/(4\,Le)$, where L represents a length between both longitudinal ends of the liquid column resonance liquid chamber, Le represents a distance between a longitudinal end of the liquid column resonance liquid chamber closer to the liquid common supply path and the nozzle closest to the longitudinal end, c represents a sonic speed in the toner constituents liquid, and N represents an integer.

* * * * *